US007198110B2

(12) United States Patent
Kilgore et al.

(10) Patent No.: US 7,198,110 B2
(45) Date of Patent: Apr. 3, 2007

(54) TWO SLIP RETRIEVABLE PACKER FOR EXTREME DUTY

(75) Inventors: Marion D. Kilgore, Dallas, TX (US); Daniel L. Patterson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 274 days.

(21) Appl. No.: 10/690,737

(22) Filed: Oct. 22, 2003

(65) Prior Publication Data

US 2005/0087347 A1 Apr. 28, 2005

(51) Int. Cl.
*E21B 23/01* (2006.01)

(52) U.S. Cl. ..... 166/387; 166/120; 166/134; 166/382

(58) Field of Classification Search ..... None
See application file for complete search history.

(56) References Cited

U.S. PATENT DOCUMENTS 3,722,588 A * 3/1973 Tamplen ..... 166/123
4,018,272 A * 4/1977 Brown et al. ..... 166/119
4,078,606 A * 3/1978 Montgomery ..... 166/120
4,754,812 A * 7/1988 Gentry ..... 166/313
5,311,938 A 5/1994 Hendrickson et al. ..... 166/134
5,433,269 A 7/1995 Hendrickson ..... 166/134
6,112,811 A 9/2000 Kilgore ..... 166/134
6,202,747 B1 * 3/2001 Lacy et al. ..... 166/120
2004/0035589 A1 2/2004 Kilgore et al. ..... 166/383

* cited by examiner

*Primary Examiner*—Zakiya W. Bates
(74) *Attorney, Agent, or Firm*—Al C. Metrailer

(57) ABSTRACT

A packer includes one dual, or double acting, slip and a single acting slip positioned on a mandrel on opposite sides of a packing element and a setting cylinder. The single acting slip is designed to resist forces acting on the mandrel in one direction. Setting forces generated by the setting cylinder are coupled to the mandrel through a releasing sleeve. When the releasing sleeve is decoupled from the mandrel, the slip setting forces on both slips and the packing element are released and the packer can be retrieved from a well. In a preferred form, the releasing sleeve may be decoupled from the mandrel by multiple means.

25 Claims, 27 Drawing Sheets

TWO SLIP RETRIEVABLE PACKER FOR EXTREME DUTY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The present invention relates generally to equipment utilized, and operations performed, in conjunction with subterranean wells and, in embodiments described herein, more particularly to a two slip retrievable packer for extreme duty.

Conventional hydraulically set retrievable packers have three main components, at least one slip, packing elements and a setting cylinder all of which are assembled on a mandrel. Typical packers have a dual slip on top, packing elements in the middle and a setting cylinder on the bottom. This design works well in many typical well applications. However, the design has limitations on the loads it can bear. Upthrust on the mandrel due to pressure below the packer and/or applied upstrain on the tubing above sometimes cause excessive loads to be generated in the packing element. The packing element sustains two additive loads in this design. One load is the applied hydraulic pressure differential across the packer. This pressure is contained by the well casing and the element mandrel on which the packing elements ride. Any upthrust on the mandrel eventually terminates at the dual slip and into the casing. This second load must be transmitted through the packing elements to reach the slip. This mechanical load translates into additional element pressure, i.e. rubber pressure. This pressure is additive to the imposed hydraulic pressure.

For example, an extreme packer application may call for a packer to withstand 10,000 p.s.i. differential hydraulic pressure imposed from below, plus an additional tubing tension load, or upward pressure differential load on the mandrel, of 300,000 pounds. The mechanical load adds to the rubber pressure from the hydraulic pressure load. The rubber area exposed to the mechanical load is the difference in area of the casing internal diameter and the element mandrel outer diameter. In a typical case this area may be 25 square inches. For this area, a 300,000 pound load creates 12,000 p.s.i. rubber pressure, i.e. 300,000 divided by 25. This mechanically generated pressure load adds to the actual hydraulic pressure to produce a total pressure load on the packing elements of 22,000 p.s.i. The casing is subjected to this pressure as a burst load, and the mandrel is exposed to this pressure as a collapse load. In many cases, the well casing cannot be expected to sustain this pressure. If it does not have a solid cement sheath, it will fail.

In U.S. Pat. No. 6,112,811, a packer having two dual or double acting slips provided a solution to the problem of combined mechanical and hydraulic pressure loads on the packing elements. In that system, two dual slips were arranged so that one half of each dual slip resisted hydraulic pressure, up or down, applied to the packing elements and the other half of each dual slip resisted loads applied to the mandrel. The packing element was not exposed to a combination of the two types of loads. In that arrangement, the well casing is used as a tension member to store at least part of the setting force of the packer. This is a typical arrangement in two slip permanent packers also. However, in order for the packer to be retrievable, there must be some mechanism for effectively shortening the mandrel between the slips to release the tension in the well casing so that the dual slips can release from the casing. As reference to U.S. Pat. No. 6,112,811 shows, such releasing mechanisms require multiple releasing elements for releasing the setting force on the packing elements and for applying releasing forces to multiple wedges in order to actually release the two dual slips. Failure of one or more of the releasing elements to function properly may prevent retrieval of the packer or may require use of an explosive tubing cutter to sever the mandrel. It may be necessary to destroy the packer in order to remove it from the well.

It would be desirable to provide a packer which avoids excessive forces applied to packing elements, and which has a simplified releasing mechanism.

SUMMARY

A packer according to the one embodiment includes one dual, or double acting, slip and a single acting slip positioned on a mandrel on opposite sides of a packing element and a setting cylinder. The single acting slip is designed to resist forces acting on the mandrel in one direction.

In one embodiment, setting forces are coupled to the mandrel through a release sleeve. When the release sleeve is decoupled from the mandrel, the setting forces on both slips and the packing element are released and the packer can be retrieved from a well. In a preferred form, the release sleeve may be decoupled from the mandrel by multiple triggering apparatus and methods.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
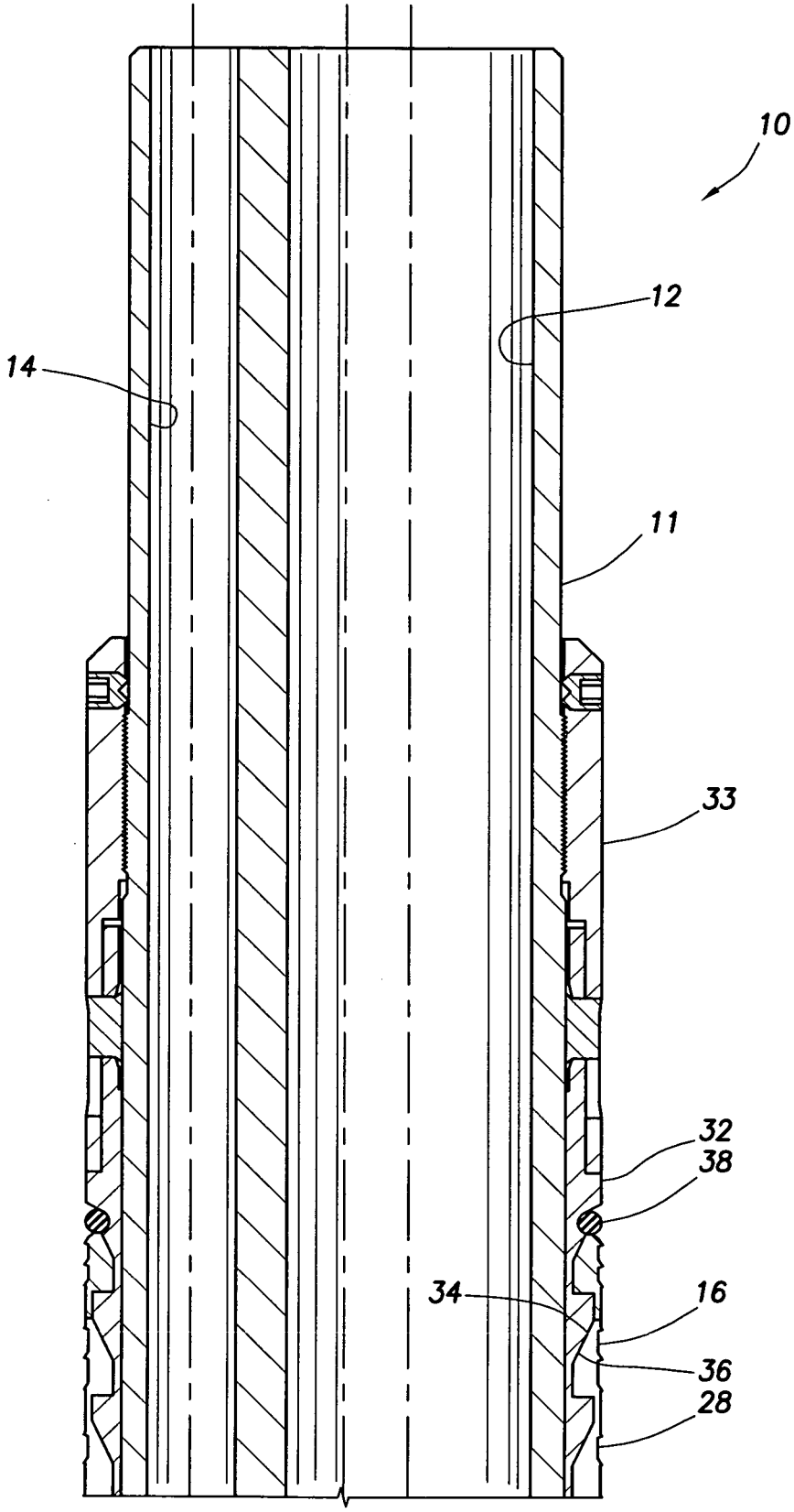
FIGS. 1A–G are successive axial portions of a cross-sectional view of a packer in its run configuration.

Representatively illustrated in FIGS. 1A–1G is a packer 10 which embodies principles of the present invention. In the following description of the packer 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

The packer 10 is described herein as an example of a well tool which may be set and released in a well bore using the principles of the invention. The packer 10 is a well tool of the type which grips and seals against a well bore in which it is set. After being set in the well bore, the packer 10 may be released, or "unset", thereby relieving its gripping and sealing engagement with the well bore so that it may be removed from the well bore. As used herein, the term "set" is used to refer to an operation producing a gripping and/or sealing engagement between a well tool and a well bore, and the term "release" is used to refer to an operation which relieves the gripping and/or sealing engagement between the well tool and the well bore.

The packer 10 is similar in many respects to a Model DHC dual string packer marketed by Halliburton Energy Services, Inc. and well known to those skilled in the art. For example, the packer 10 includes a mandrel 11 on which essentially all other elements are carried or assembled. Primary and secondary flow passages 12, 14 extend through mandrel 11. The primary flow passage 12 may, for example, be used for producing well fluids to the surface, and the secondary flow passage 14 may be used for gas injection. Carried on mandrel 11 are a dual slip 16, seal elements 18 and a setting cylinder assembly 20, FIG. 1C.

The packer 10 is also similar to the apparatus described in the above referenced U.S. Pat. No. 6,112,811, which includes two dual slips, one above its packing elements and one below. In addition to the dual slip 16 above seal elements 18, packer 10 includes a single acting slip 22 below the setting cylinder assembly 20. The embodiment described herein is for applications where the extreme loads are due to high pressures below the packer. Depending on the specific application, the slip positions may be reversed, that is the single acting slip may be at the upper end of the packer and the dual slip may be at the lower end of the packer.

Figure 1B:
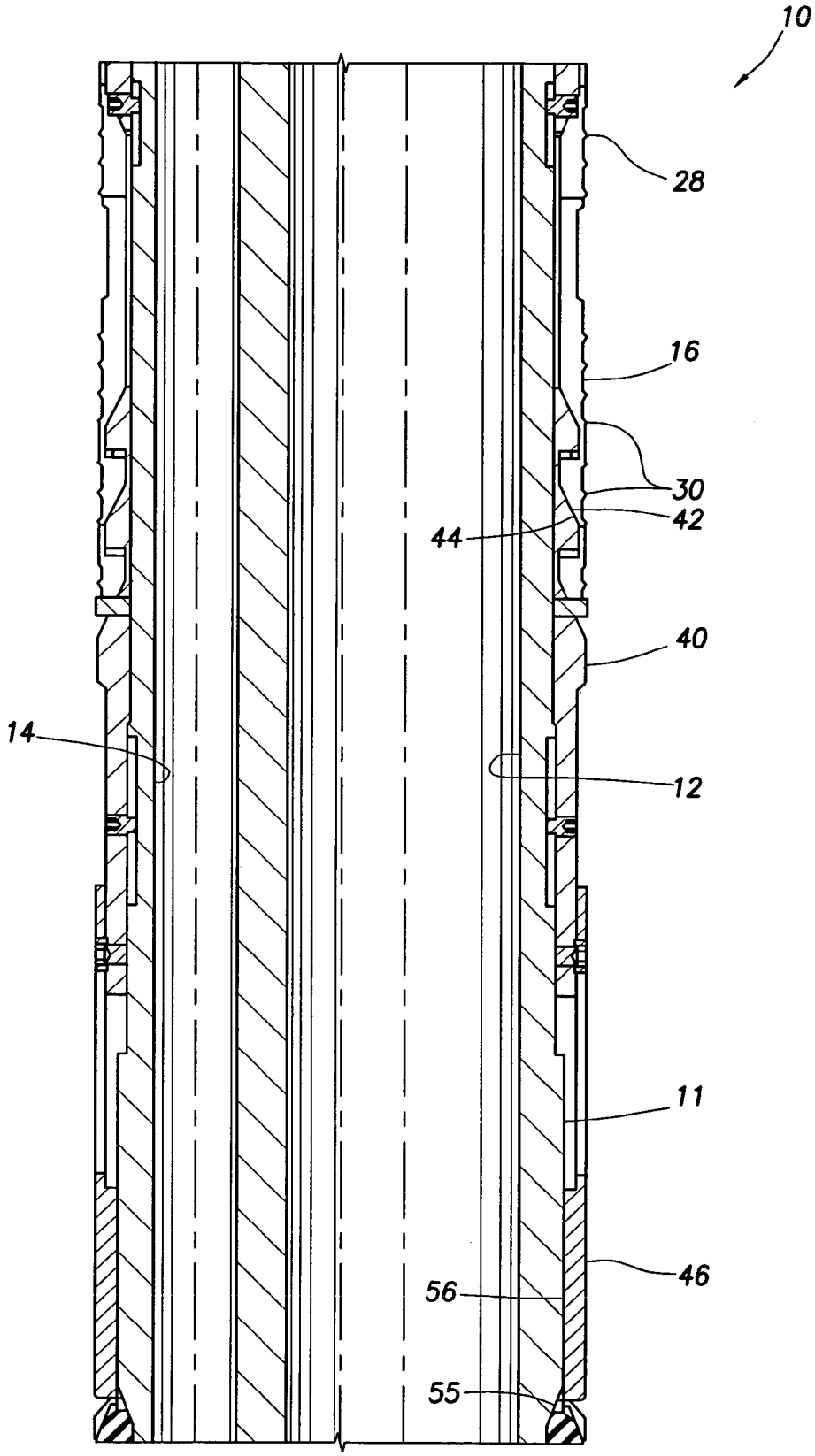
Figure 1C:
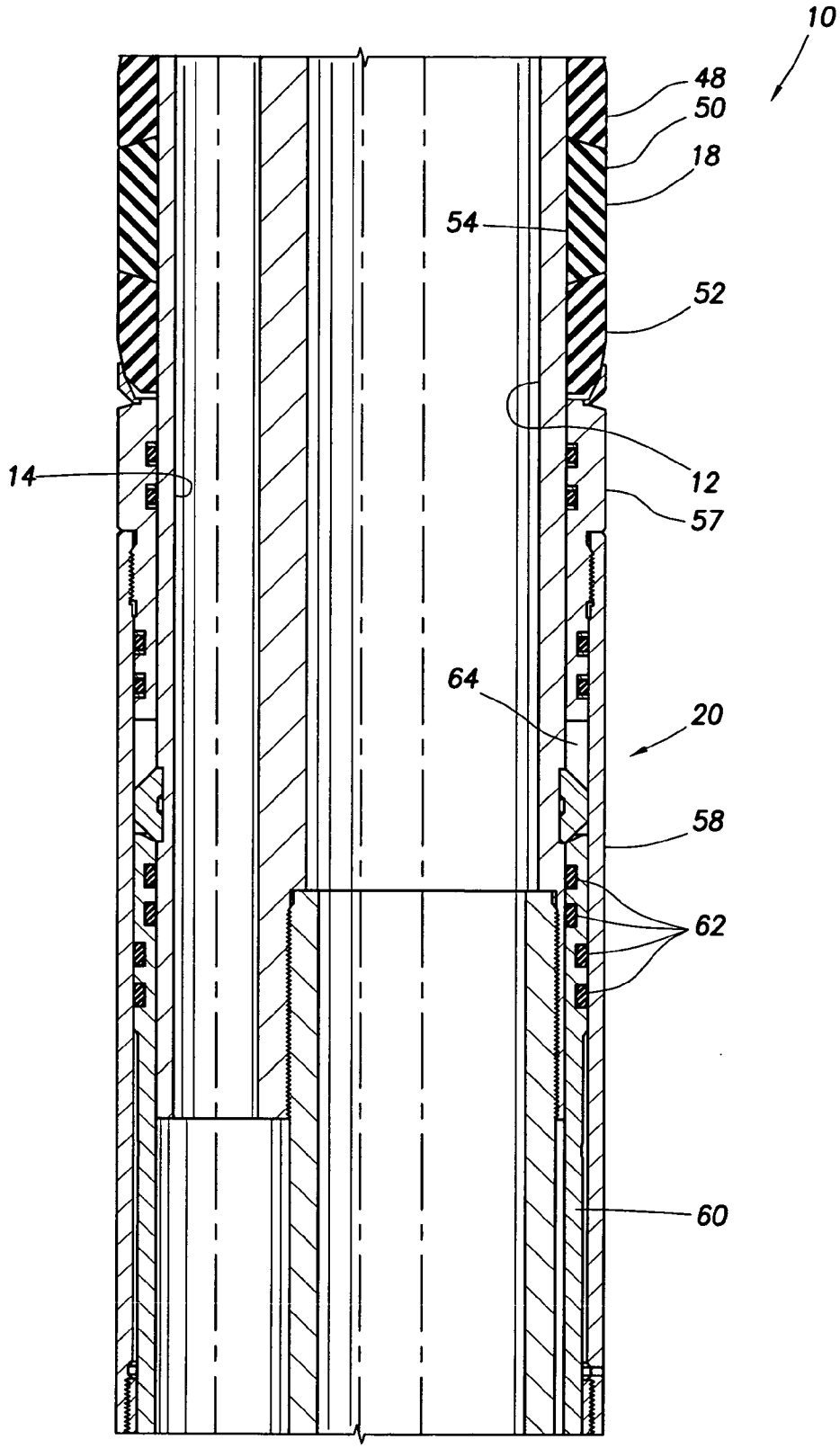
Figure 1D:
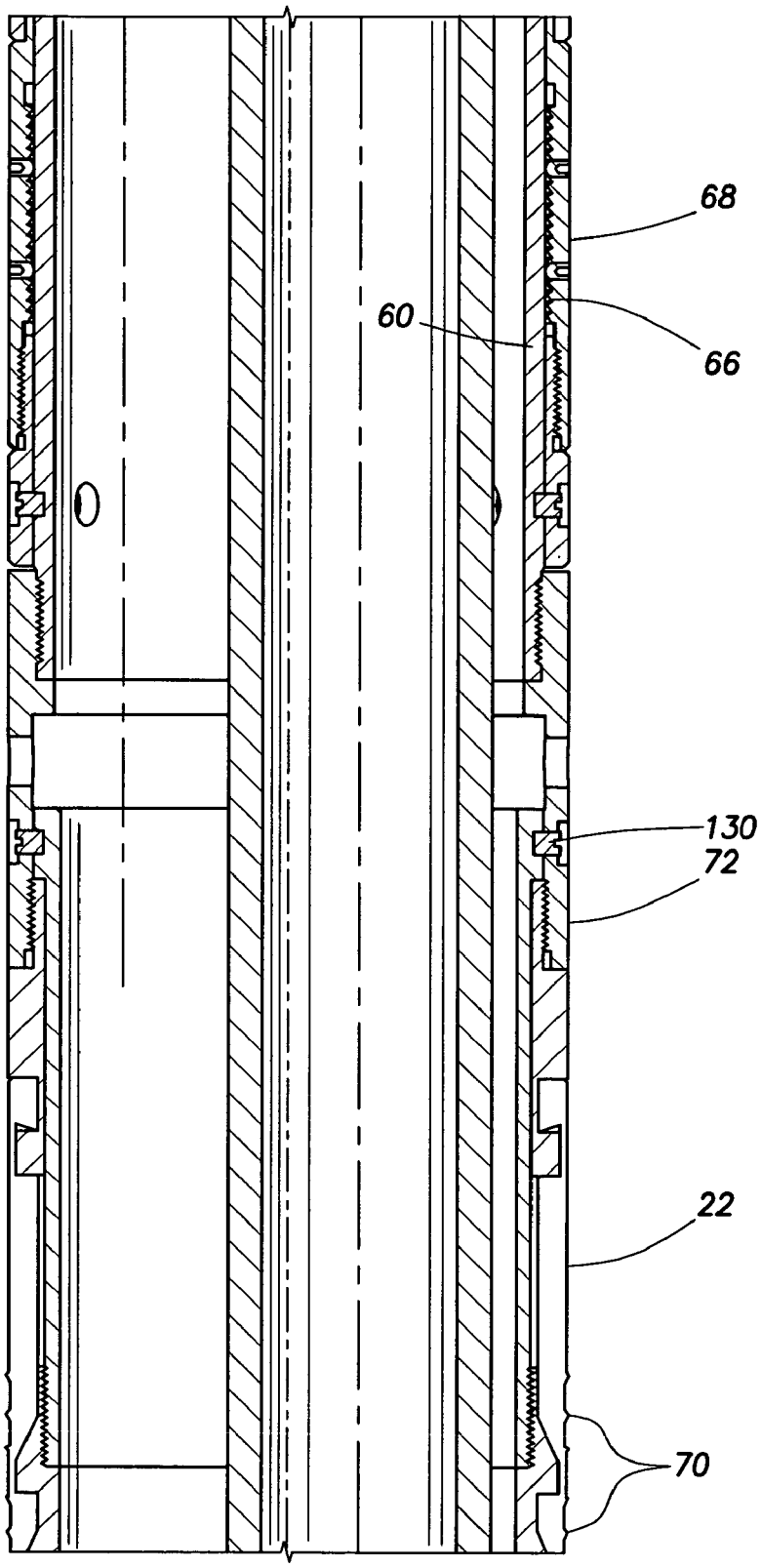
Figure 1E:
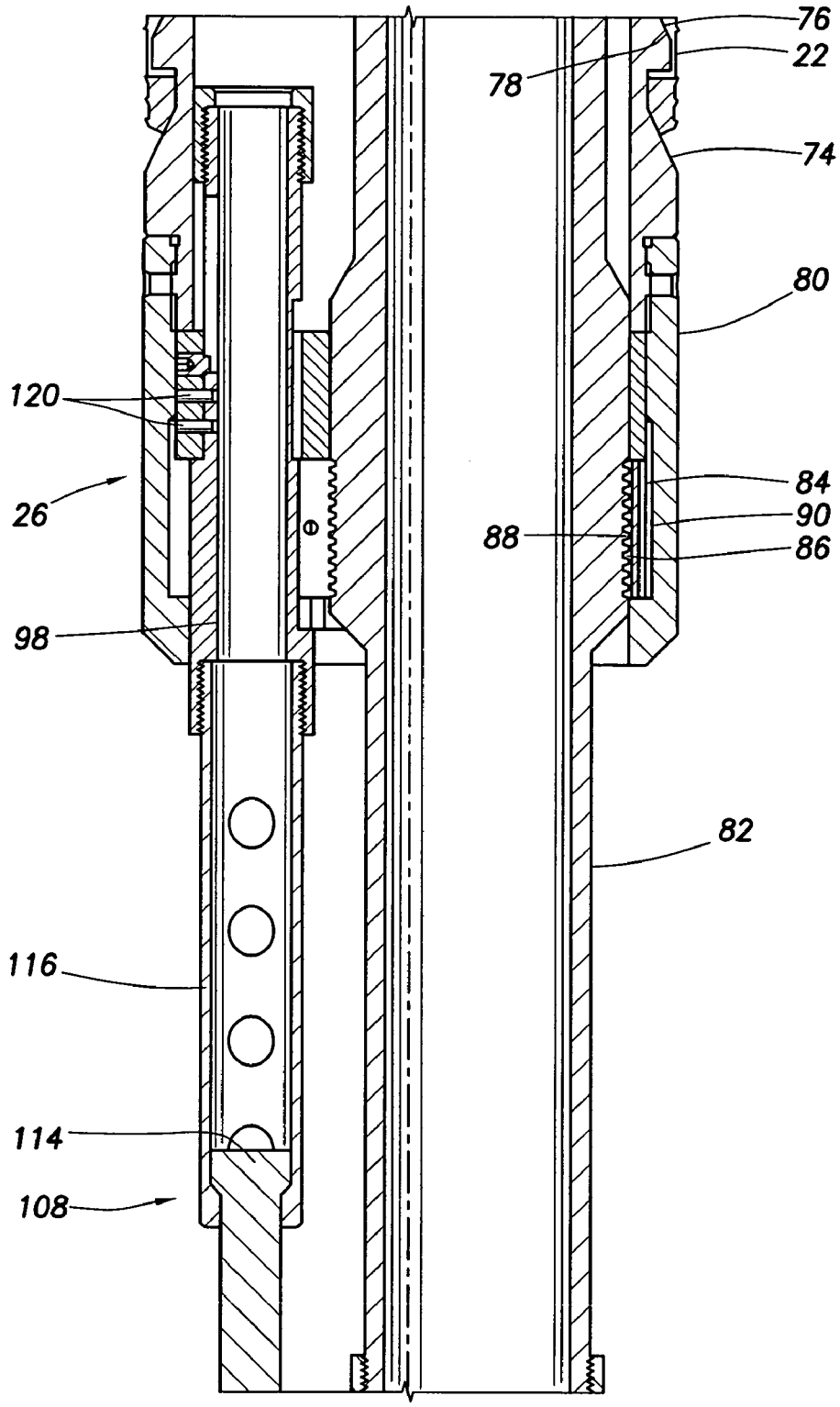

A release ring 80, FIG. 1E, is provided for releasing the packer 10 after it has been set in a well. Multiple trigger mechanisms are provided for the release mechanism, as will be described in more detail below.

The above described design of a packer according to the present invention resulted in part from a discovery concerning the most common loads experienced in extreme packer applications. As noted above, in extreme applications, the combination of direct hydraulic loads on the packer elements and the loads transferred through the mandrel to the packer elements may generate destructive loads to the elements themselves or to the well casing. U.S. Pat. No. 6,112,811 solved this problem by using two dual slips arranged to apply the direct hydraulic loads on the seal elements to one half of each dual slip and the mandrel forces to the other half of each dual slip. However, this design results in setting forces appearing as tension in the casing and this requires complicated release mechanisms which may fail. The present inventors have discovered that, in many extreme packer applications, the extreme mandrel forces occur in only one direction. Extreme single direction mandrel forces can be resisted by a single acting slip positioned to resist mandrel forces from the side opposite the dual slip. By using a single acting slip as the second slip in a two slip design, releasing apparatus may be very simple and very reliable.

The above described elements make up the primary components of the packer 10 according to an embodiment of the present invention. More details of the packer 10, its methods of operation and various release trigger mechanisms and methods are provided below. In FIGS. 1A through 1G, the various elements of the packer 10 are shown in their run positions, that is, the positions when the packer 10 is run in or lowered into a well in preparation for setting the packer 10 in the well.

With reference to FIGS. 1A and 1B, more details of the dual slip 16 will be described. Dual slip 16 includes downward facing teeth 28 on its upper end for engaging a borehole wall or casing and resisting downward forces applied to the mandrel 11. Slip 16 includes upward facing teeth 30 on its lower end for engaging a borehole wall or casing and resisting upward forces applied to the seal elements 18. It is the two sets of teeth 28 and 30 facing in opposite directions and reacting to forces in opposite directions which makes slip 16 a dual or double acting slip.

Dual slip 16 in this embodiment is a circumferentially continuous axially slotted barrel slip of the type well know to those of ordinary skill in the art. However, it is to be clearly understood that the slip 16 may be differently configured without departing from the principles of the present invention. For example, the teeth 28 and 30 or other gripping structures may be separately attached to the remainder of the slip, the slip 16 may be C-shaped or otherwise circumferentially discontinuous, the slip 16 may be circumferentially divided into slip segments, the slip 16 may be formed of two single acting slips (circumferentially continuous, segmented, etc.) facing in opposite directions, etc.

A first wedge 32 is carried between the mandrel 11 and the upper portion of slip 16 and is held in position by an upper sub 33 so that it cannot move upward relative to the mandrel 11, although it is allowed to move downward a limited distance for unsetting the packer as discussed below. Slip 16 and wedge 32 have matching slanted surfaces 34 and 36 which cause the slip 16 to expand radially as it is moved upward relative to the wedge 32. A debris barrier 38 is preferably provided at the upper end of slip 16 to prevent debris, e.g. sand, from flowing between the slip 16 and the wedge 32, when the slip 16 is expanded radially.

A second wedge 40 is carried between the mandrel 11 and the lower end of slip 16 and extends below slip 16. Wedge 40 may slide to a limited extent in either direction relative to the mandrel 11. Slip 16 and wedge 40 have matching slanted surfaces 42 and 44 which cause the slip 16 to expand radially as the wedge 40 is moved upward relative to the slip 16. The wedge 40 is connected to, and slides with, a cover sleeve or upper element retainer 46, the lower end of which rests on the top of seal elements 18.

As shown in FIG. 1C, the seal elements 18 may comprise three separate seal members 48, 50 and 52. These elements may typically be made of an elastomeric material such as rubber but may be constructed of other materials familiar to those skilled in the art. In the run position, the elements 18 are carried on a portion 54 of mandrel 11 having a first outer diameter. Just above the seal member 48, the mandrel 11 has a prop surface 56, FIG. 1B, having an outer diameter larger than the portion 54. Between the portion 54 and the prop surface 56 is a slanted surface 55, up which at least some of the seal members 48, 50 and 52 slide during the process of setting the packer 10 in a well. Below and in contact with the lower edge of seal member 52 is a lower element retainer 57 which also functions as a setting piston.

Figure 3:
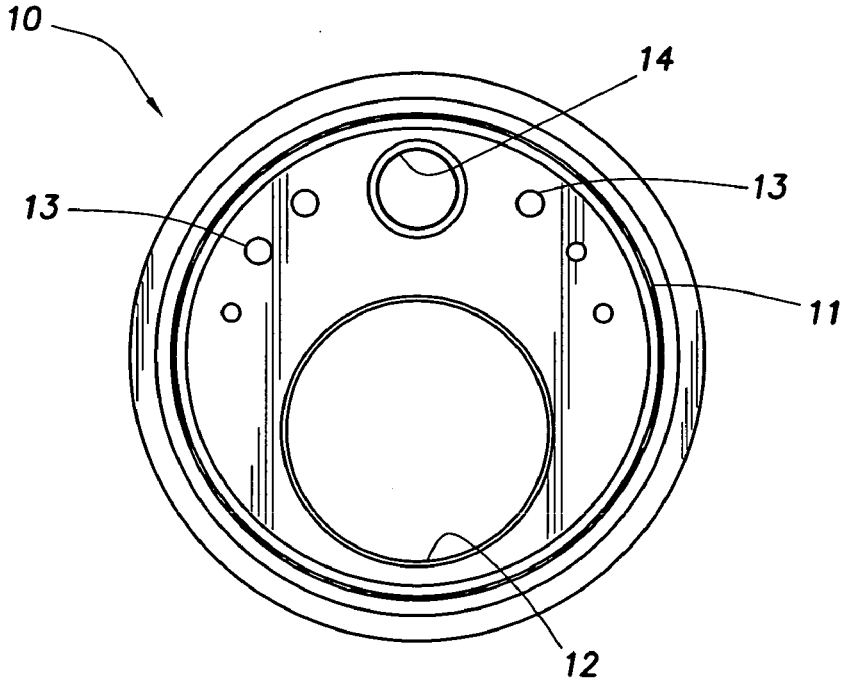
FIG. 3 is a top view of the packer.

With reference to FIGS. 1C and 1D, more details of the setting cylinder assembly 20 will be described. The cylinder assembly 20 includes an outer cylindrical sleeve 58 having an upper end connected to the lower end of lower element retainer 57, and an inner cylindrical sleeve 60 carried between the outer sleeve 58 and the mandrel 11. Sliding seals 62 are provided between the inner sleeve 60 and each of the outer sleeve 58 and the mandrel 11. A space 64 between the upper end of inner sleeve 60 and the lower end of the lower retainer 57 is in fluid communication with a flow passage in the mandrel 11, e.g. the main flow passage 12 or one of the control line passageways 13 shown in FIG. 3. The packer 10 may be set by applying fluid pressure to the space 64 and thereby driving retainer 57 and sleeve 58 upward, while driving inner sleeve 60 downward. As shown best in FIG. 1D, ratchet teeth 66 are provided between a portion of the outer surface of inner sleeve 60 and an inner surface of an extension sleeve 68 connected to the lower end of outer sleeve 58. The ratchet teeth 66 allow the sleeve 58 to move upward relative to the sleeve 60, but resist movement in the opposite direction. The ratchet teeth 66 may thereby hold the packer 10 is a set condition.

With reference to FIGS. 1D and 1E, more details of the lower slip 22 and its connection to the setting cylinder assembly 20 will be described. Slip 22 includes upward facing teeth 70 for engaging a borehole wall or casing and resisting upward forces applied to the mandrel 11. Slip 22 does not have teeth for resisting downward directed forces and does not have an upper wedge and thus is considered a single acting slip. The upper end of slip 22 is coupled through an adaptor 72 to the lower end of inner cylinder sleeve 60. A lower wedge 74 is carried between mandrel 11 and slip 22 and extends below slip 22. The wedge is prevented from moving downward relative to mandrel 11, in the run and set conditions, by the release ring 80. The slip 22 and wedge 74 have matching slanted surfaces 76 and 78 which cause the slip 22 to expand radially when it is forced downward relative to the wedge 74.

Slip 22 in this embodiment is a circumferentially continuous axially slotted single acting barrel slip of the type well know to those of ordinary skill in the art. However, it is to be clearly understood that the slip 22 may be differently configured without departing from the principles of the present invention. For example, the teeth 70 or other gripping structures may be separately attached to the remainder of the slip, the slip 22 may be C-shaped or otherwise circumferentially discontinuous, the slip 22 may be circumferentially divided into slip segments, etc.

FIG. 1E provides more details of the coupling of release ring 80 to the mandrel 11 by release mechanism 26. In the run and set conditions, the release ring 80 is prevented from moving longitudinally relative to the mandrel 11. The release ring 80 is carried on a lower mandrel, or mandrel extension, 82 which is connected to the lower end of primary flow passage 12 in mandrel 11 and provides an extension of flow passage 12. The release ring 80 is coupled to the extension 82 by an anchor ring 84 in the run and set conditions. The anchor ring 84 has annular teeth 86 on its inner surface which engage matching grooves 88 on the outer surface of extension 82. The outer surface of the anchor ring 84 engages a groove 90 on the inner surface of release ring 80. So long as the release ring 80 is thus rigidly coupled to the mandrel 11, all downward forces generated by the setting cylinder 20 are transferred through the release ring 80 to the mandrel 11 and are balanced by tension forces in the mandrel 11. As explained in detail below, release or unsetting of the packer 10 may be achieved by decoupling the release ring 80 from the mandrel 11 and allowing it to move downward relative to the mandrel 11, thereby releasing the setting forces.

The elements described in detail above with reference to FIGS. 1A–1E are the primary elements used in setting the packer 10 in a well. More details of the process of setting the packer 10 are provided below with reference to FIGS. 6A–6E. Elements shown in FIGS. 1E–1G and FIG. 4 are primarily used in various methods of releasing or unsetting the packer 10 after it has been set in a well.

Figure 4:
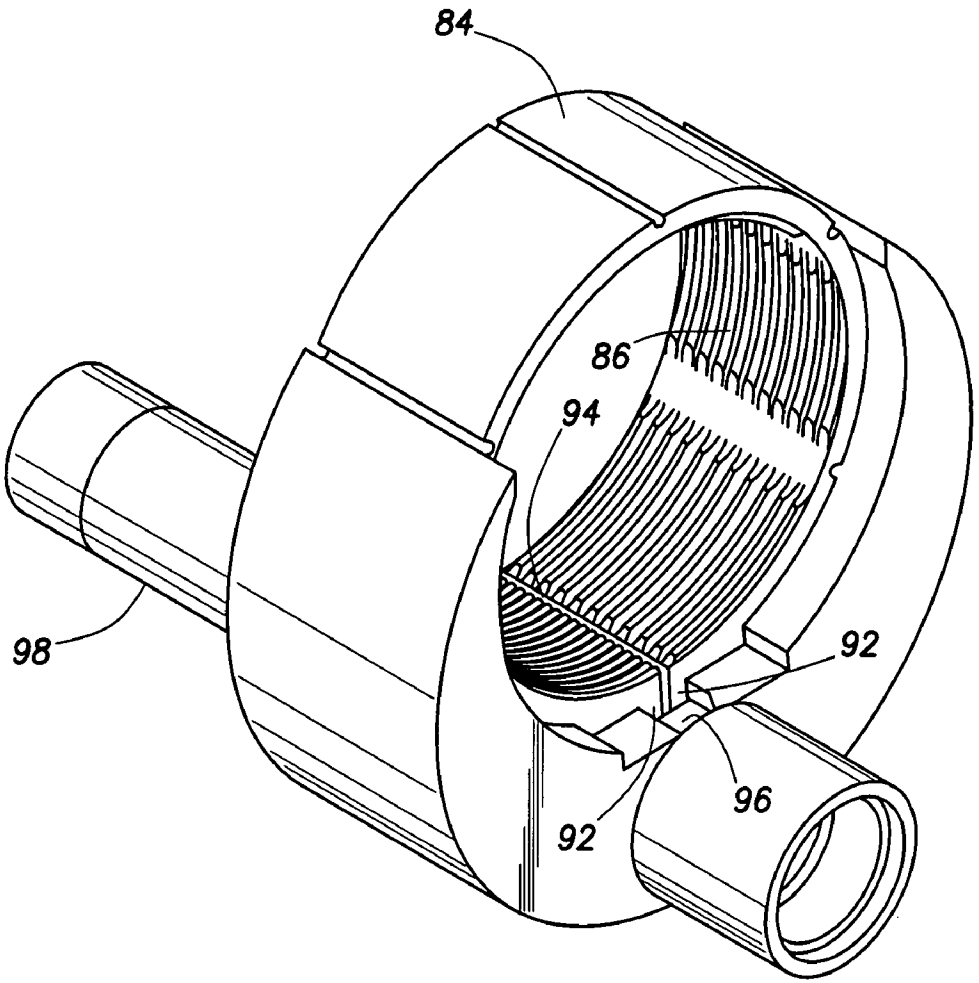
FIG. 4 is an isometric view of a release mechanism of the packer.

FIG. 4 shows more detail of the anchor ring 84 and one release activation apparatus. The anchor ring 84 is a split or C-ring having radial flanges or ears 92 on each side of a split 94. The flanges or ears 92 may be held together in a slot 96 in a clamp 98 to keep the anchor ring 84 engaged with the mandrel extension 82 and prevent the release ring 80 from moving relative to the mandrel extension 82. Release of the anchor ring 84 from the extension 82 may be achieved by moving the clamp 98 downward relative to the anchor ring 84, which allows the flanges 92 to separate, which in turn releases the teeth 86 from the grooves 88 and allows the release ring 80 to slide relative to the mandrel extension 82 and therefore relative to mandrel 11. Various mechanical and hydraulic apparatus and methods are described below for moving clamp 98 to cause the release ring 80 to move and unset the packer 10. The packer may also be unset or released by severing the mandrel extension 82 and thereby decoupling the release ring 80 from mandrel 11, even though it may remain coupled to a lower portion of the severed extension 82.

Although the anchor ring 84 is described herein as being a means by which the release ring 80 is releasably retained against displacement relative to the mandrel 11, other retaining means may be used, if desired. For example, a supported collet, supported lugs or dogs, supported snap ring, etc.

Figure 1F:
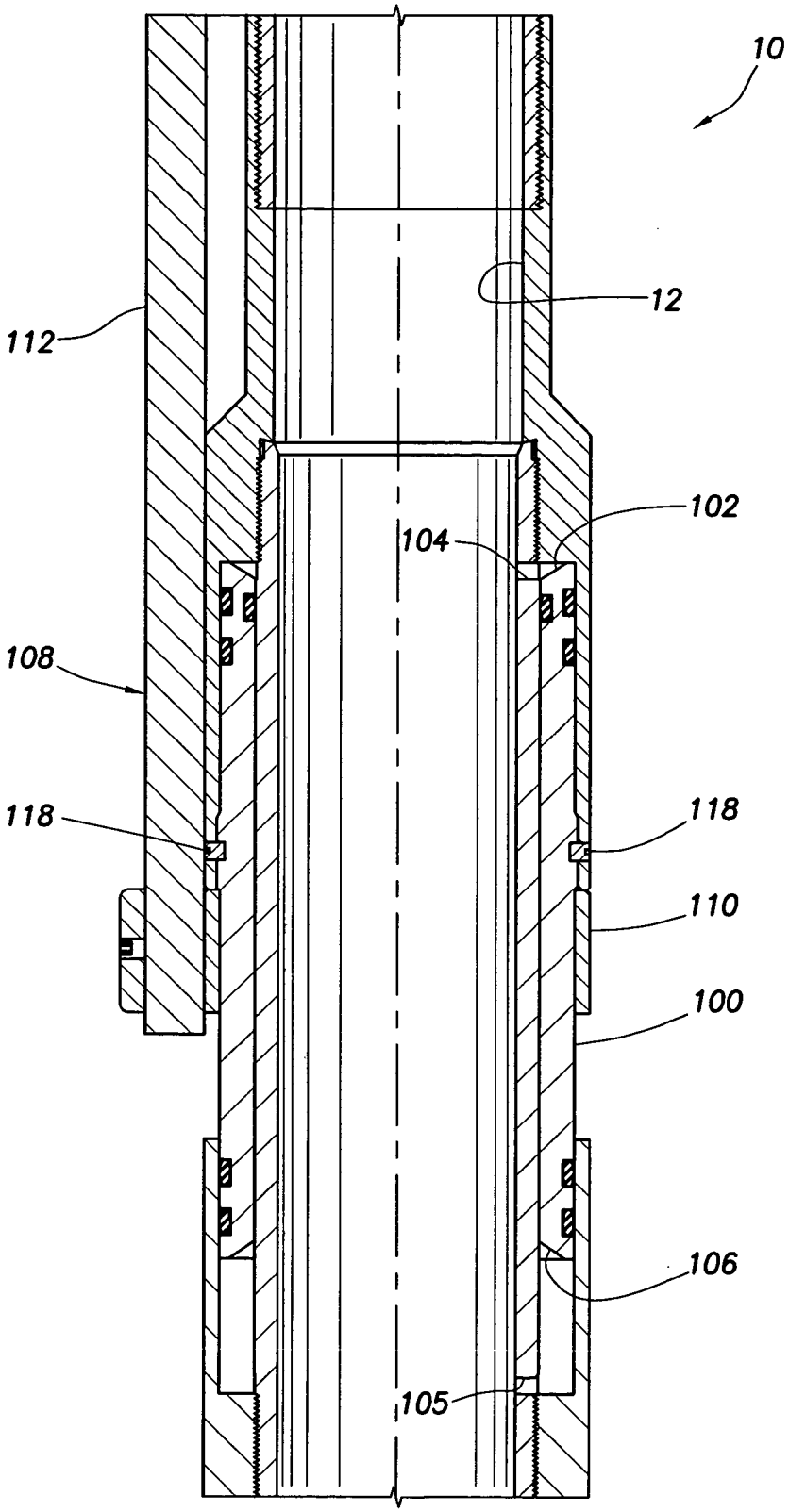
Figure 1G:
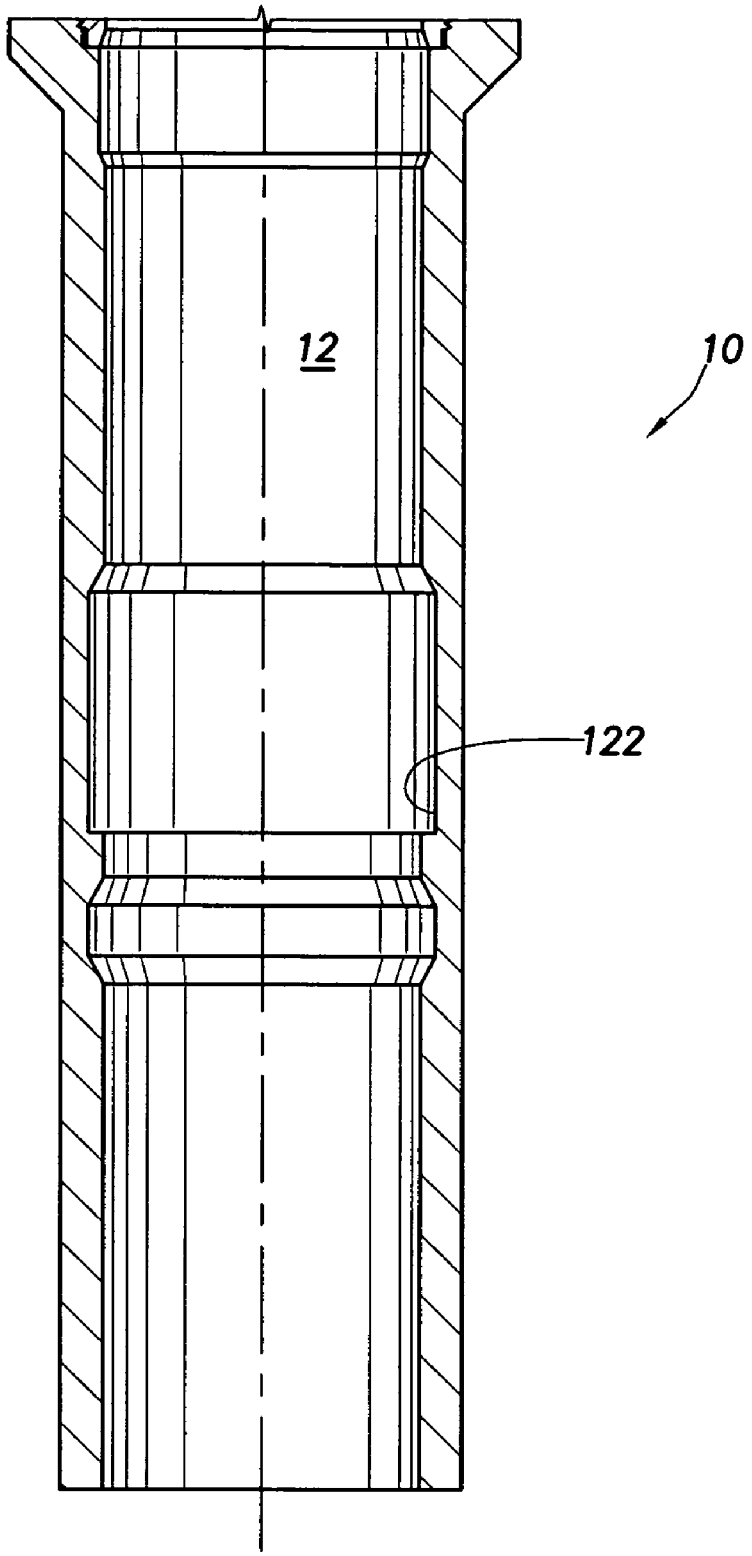

With reference to FIGS. 1E, 1F and 1G, one apparatus for moving the clamp 98 and thereby triggering movement of release sleeve 80 will be described. An annular piston 100 is sealingly and reciprocably disposed about the primary flow passage 12 through the mandrel extension 82. An upper piston area or side 102 of the piston 100 is in fluid communication with the flow passage 12 via a port 104. A lower piston area or side 106 of the piston 100 is in fluid communication with the flow passage 12 via a port 105. When a pressure differential is created across the piston 100 from the upper side 102 to the lower side 106, the piston will be biased to displace downwardly.

Although the piston 100 is described herein as being annular-shaped, it will be readily appreciated that other types of pistons could be used, such as a rod piston, etc.

The piston 100 is connected to the release mechanism 26 by a coupling 108. The coupling 108 includes a yoke 110 surrounding piston 100, a rod 112 having an enlarged end 114, and a tube 116. The rod 112 is telescopingly received in one end of the tube 116, and the other end of the tube 116 is attached to the clamp 98.

Figure 2:
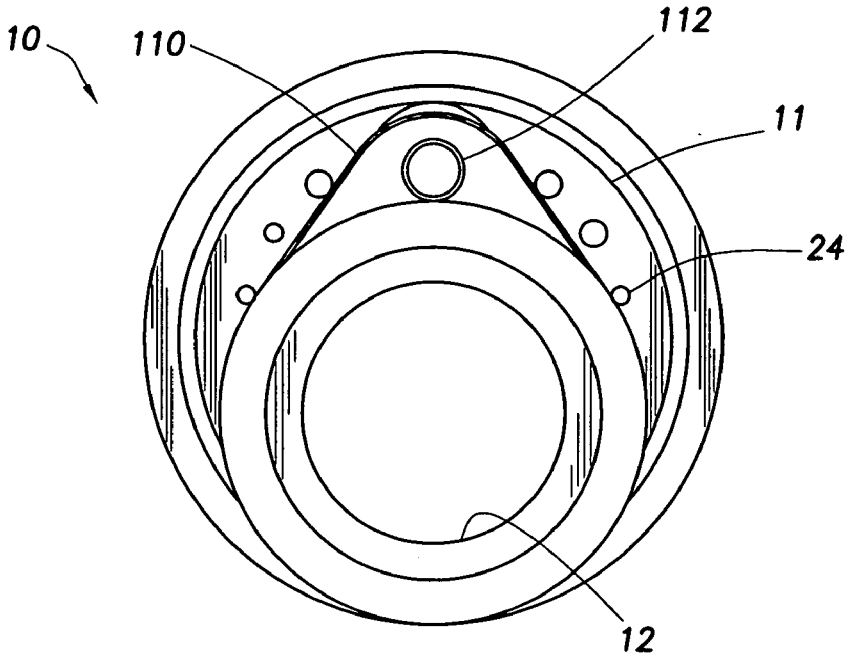
FIG. 2 is a bottom view of the packer.

The yoke 110 is rigidly secured to the piston 100 and to the rod 112. Thus, the piston 100, yoke 110 and rod 112 displace, or remain stationary, as an assembly. In the bottom view of the packer 10 representatively illustrated in FIG. 2, it may be more clearly seen how the yoke 110 is configured relative to the piston 100 and the rod 112.

The coupling 108 is of the type known as a slip or one-way coupling, in that the tube 116 (and the attached clamp 98) may displace downwardly relative to the rod 112, yoke 110, and piston 100 assembly, but when the rod 112, yoke 110, and piston 100 assembly displaces downwardly, the tube 116, and release clamp 98 assembly also displaces downwardly due to engagement of the enlarged rod end 114 with the lower end of the tube 116. This permits the clamp 98 to be displaced downwardly, thereby releasing the packer 10, without displacing the piston 100 downwardly. Various apparatus and methods are described below for moving the clamp 98 downward without moving the piston 100 downward. Thus, it is not necessary to displace the piston 100 downwardly to release the packer 10, but if the piston 100 is displaced downwardly, it will cause the clamp 98 to displace downwardly and release the packer 10.

As mentioned above, the upper and lower sides 102, 106 of the piston 100 are in fluid communication with the flow passage 12. In this embodiment of the invention, a pressure differential may be created in the flow passage 12, which pressure differential is communicated via the ports 104, 105 to the respective sides 102, 106 of the piston 100, to thereby bias the piston downward. Various apparatus and methods are described below for providing such a pressure differential. When this downwardly biasing force is sufficiently great, shear screws 118, which releasably secure the piston 100 in its run and set position, shear and the downwardly biasing force is transmitted via the coupling 108 to the clamp 98. When the downwardly biasing force transmitted to the clamp 98 is sufficiently great, shear pins 120, which releasably secure the clamp 98 in its run and set positions, shear and the clamp 98 displaces downward, along with the coupling 108 and piston 100, thereby releasing the packer 10, as explained in detail below with reference to FIGS. 6A–6E.

With reference to FIG. 1G, the lowermost portion of packer 10 is illustrated. In this lower extension of the primary flow path 12, there is provided a profile 122. The profile 122 may be used to position various devices lowered down through flow path 12, as described below, to generate a pressure differential needed to move the piston 100.

In the packer 10, the flow passages 12, 14 are integrally formed in a single mandrel 11. In the top view of the packer 10 illustrated in FIG. 3, the manner in which the two flow passages 12, 14 are formed in the mandrel 11 may be seen. Additional openings 13 may be formed through the mandrel 11 for control lines, other hydraulic or fluid lines, electrical lines, fiber optic lines, etc.

FIGS. 5A through 5E illustrate the packer 10 in its set configuration in a well and also illustrate one apparatus and method for releasing the packer 10. A well is represented by casing 124 which typically is installed as a well liner. The well itself and cement normally used to seal the casing in the well are not shown, but are well known in the art. On the upper end of packer 10, primary and secondary tubing strings 126 and 128 are connected to the primary and secondary flow passages 12 and 14, so that the flow passages 12, 14 extend through the tubing strings 126, 128. The tubing strings 126, 128 may be used to lower the packer 10 down the well to a desired location. Once in the desired location, fluid pressure may be applied to the setting cylinder 20 space 64, FIG. 5C. The applied pressure urges the lower element retainer 57 and outer sleeve 58, FIG. 5B, upward and the inner sleeve 60, FIG. 5C, downward. In the run position, a shear screw 130 holds the inner sleeve 160 in its uppermost position and prevents deployment of the lower slip 22. At a preselected force level, the shear screw 130 shears allowing the sleeve 60 to move down, which in turn moves the slip 22 down relative to wedge 74. This movement of slip 22 relative to wedge 74, causes the slip 22 to expand radially into contact with the well casing 124 and causes the teeth 28 to bite into the casing 124 and resist axial movement of the slip 22 relative to the casing 124.

Figure 5A:
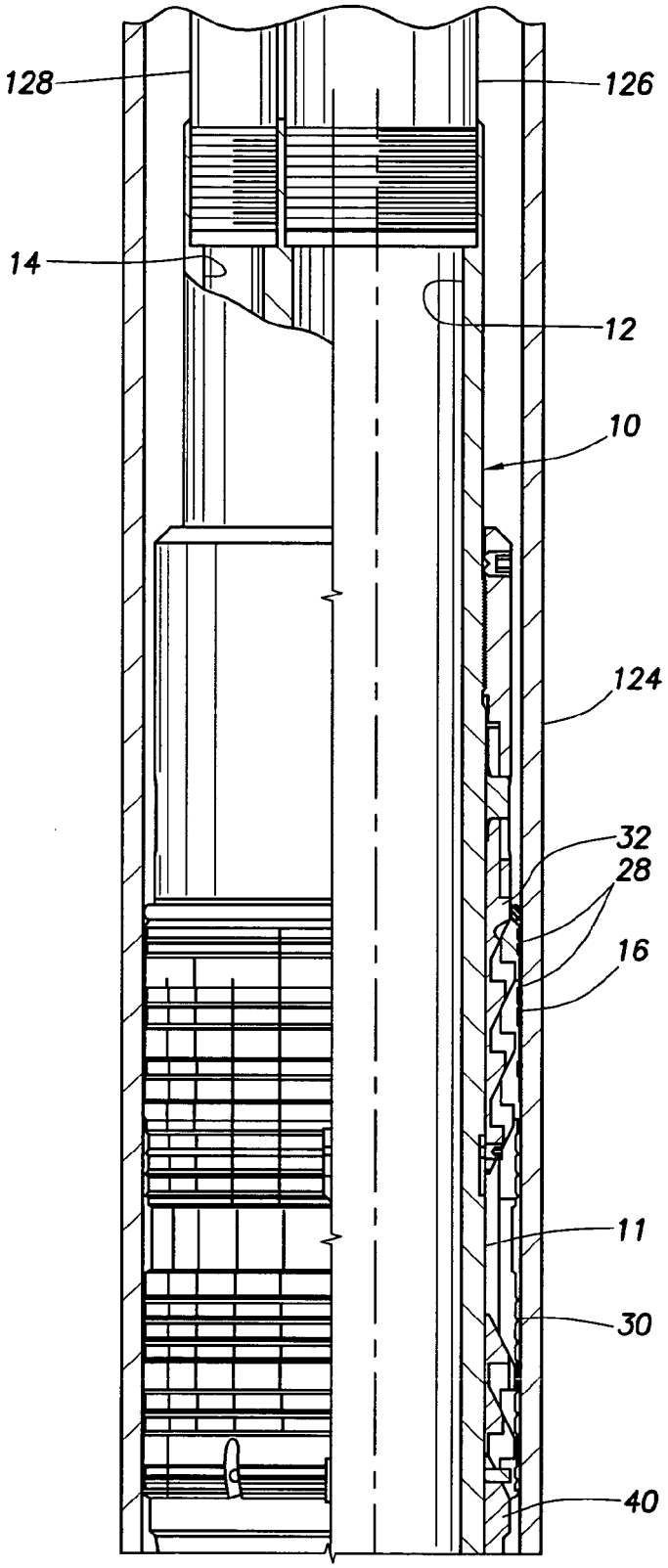
FIGS. 5A–E are successive axial portions of a cross-sectional view of the packer in a set configuration in a well and with one type of release trigger mechanism in place.
Figure 5B:
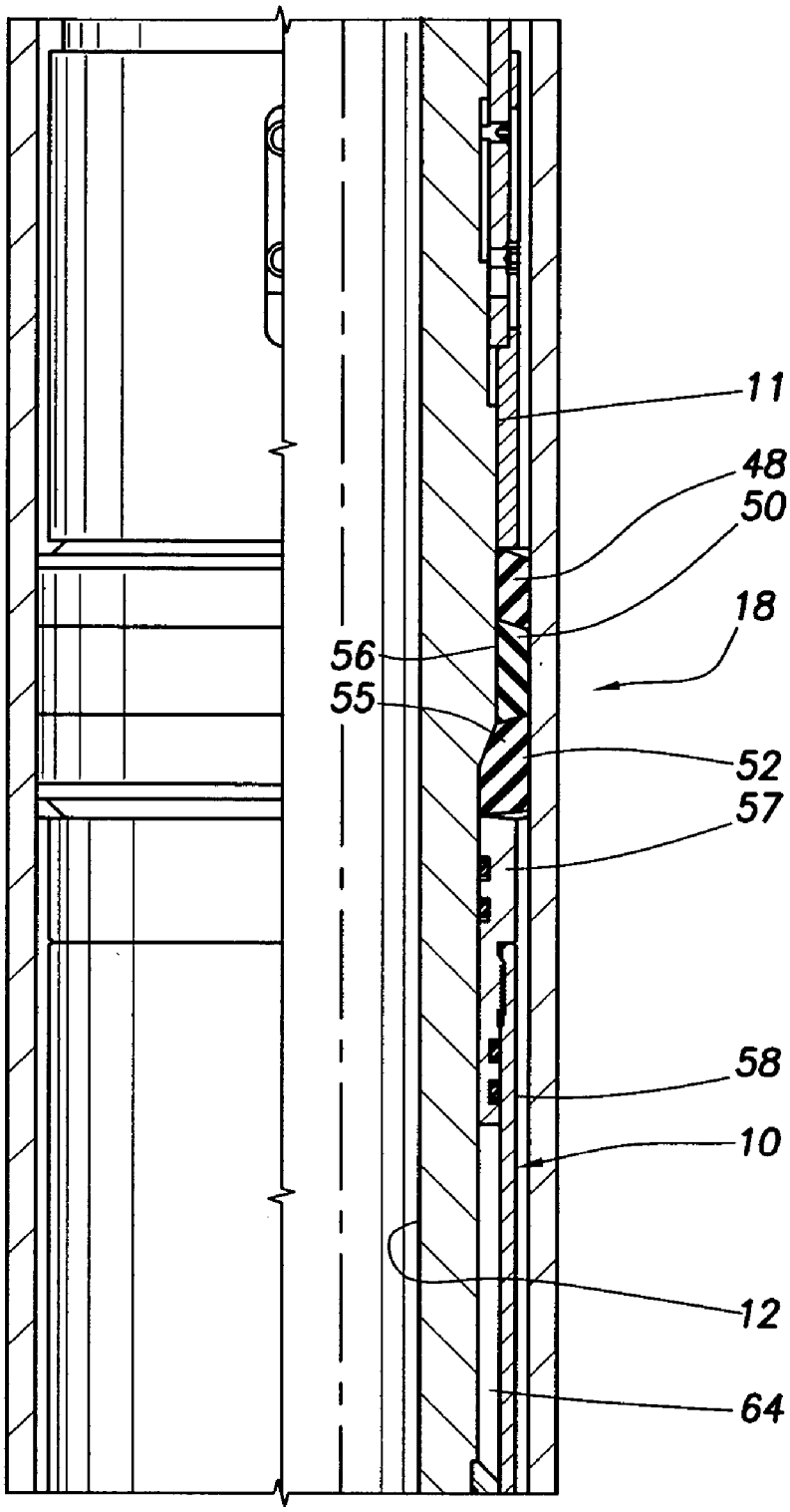
Figure 5C:
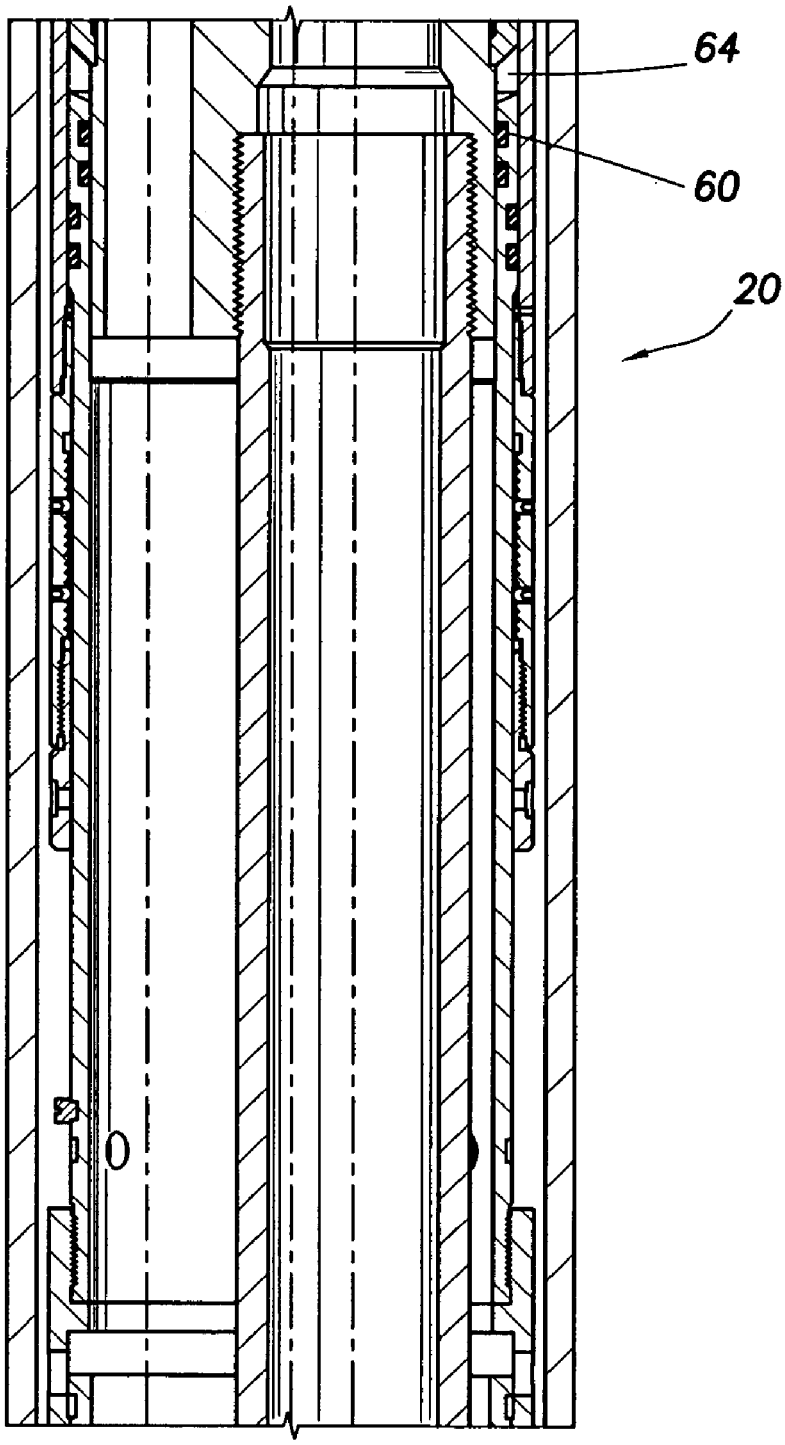

As the slip 22 is being deployed, force on lower element retainer 57 is applied to the seal elements 48, 50 and 52 and through them to the wedge 40 and slip 16. As shown in FIG. 5B, the elements 48 and 50 may slide up the slanted surface 55 and completely onto the prop surface 56, of mandrel 11. The element 52 may be partially moved up the ramp 55. The compressive forces on the elements 48, 50 and 52 from expansion cylinder 20 and from the radial expansion caused by the prop surface 56, combine to form a good fluid tight seal between the mandrel 11 and the casing 124.

The axial force on the seal elements 18 are also applied to the wedge 40 and slip 16. As the elements 18 move upward, the wedge 40 and slip 16 also move upward. The interaction of slip 16 with wedges 32 and 40 cause the slip 16 to expand radially into contact with the casing 124. The teeth 28 and 30 on the upper and lower portions of slip 16 bite into the casing 124 and resist axial movement of the slip 22 relative to the casing 124.

As the slips 16 and 22 and seal elements 18 are being set, the ratchet teeth between outer sleeve 58 and the inner sleeve 60 slip to allow the sleeve 58 to move upward and the inner sleeve 60 to move down. However, once the packer 10 has been set, the pressure may be removed from the space 64, because the ratchet teeth 66 prevent the outer sleeve 58 and the inner sleeve 60 from moving back to their run positions. The setting forces appear as compression forces in the seal element 18 and as tension force in the mandrel 11.

With further reference to FIGS. 5A–5D, the distribution of forces experienced by the packer 10 to the slips 16 and 22 will be explained. As discussed above, this embodiment is designed to withstand extreme forces in the upward direction. In the example discussed in the background section, an upward pressure differential may generate an upward load on the mandrel of 300,000 pounds. That load would be transferred through the wedge 74 to the single acting slip 22. The teeth 70 are directed upward to transfer this load into the casing 124. The upward pressure differential load applied directly to the elements 18 is transferred through wedge 40 to the slip 16. The teeth 30 on the lower end of slip 16 are directed upward to direct this load into the casing 124, but at a location different from the location of the single acting slip 22. The upward directed loads therefore are separated so that the elements 18 do not experience the combined forces and the forces are applied to casing 124 at two locations.

If the mandrel 11 should experience downward forces, they will be transferred through the wedge 32 to the upper end of slip 16. The downward facing teeth 28 on the upper end of slip 16 will transfer the downward force to the casing 124. Downward acting hydraulic forces will be applied to the elements 18 and transferred through them to the single acting slip 22. While the teeth 70 are designed to resist primarily upward forces, once the packer is set they will resist limited downward forces. To the extent the slip 22 should move relative to the casing 124, it will transfer downward force to the mandrel 11 and through it to the upper portion of the dual slip 16 as discussed above. As noted above, in many applications a packer will experience extreme forces in only one direction. In this case it is assumed that the extreme forces will only occur in the upward direction and more limited or normal forces will be experienced in the downward direction.

The elements described above with reference to FIGS. 5A–5D are primarily related to setting of the packer in a well. Elements described below with reference to FIGS. 5D and 5E are primarily related to apparatus and methods for releasing the packer 10 after it has been set in a well.

Figure 5D:
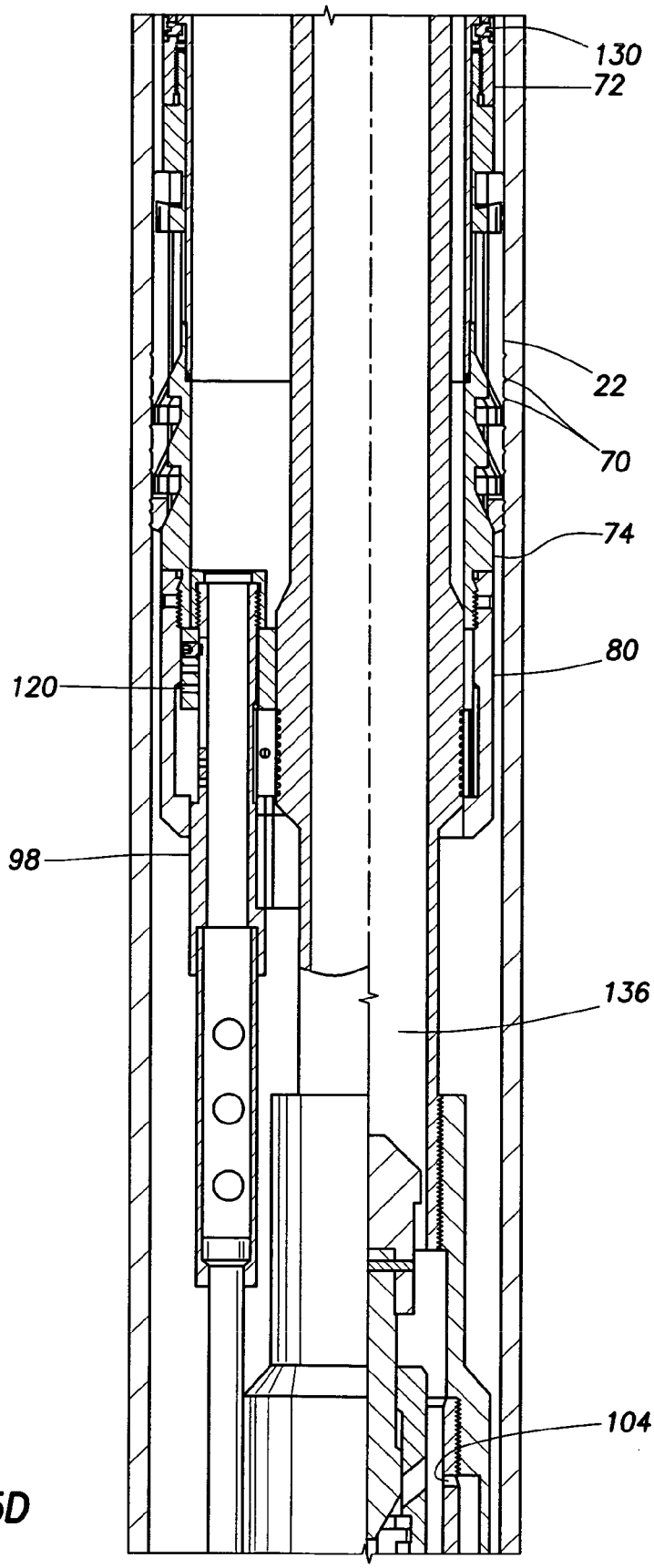
Figure 5E:
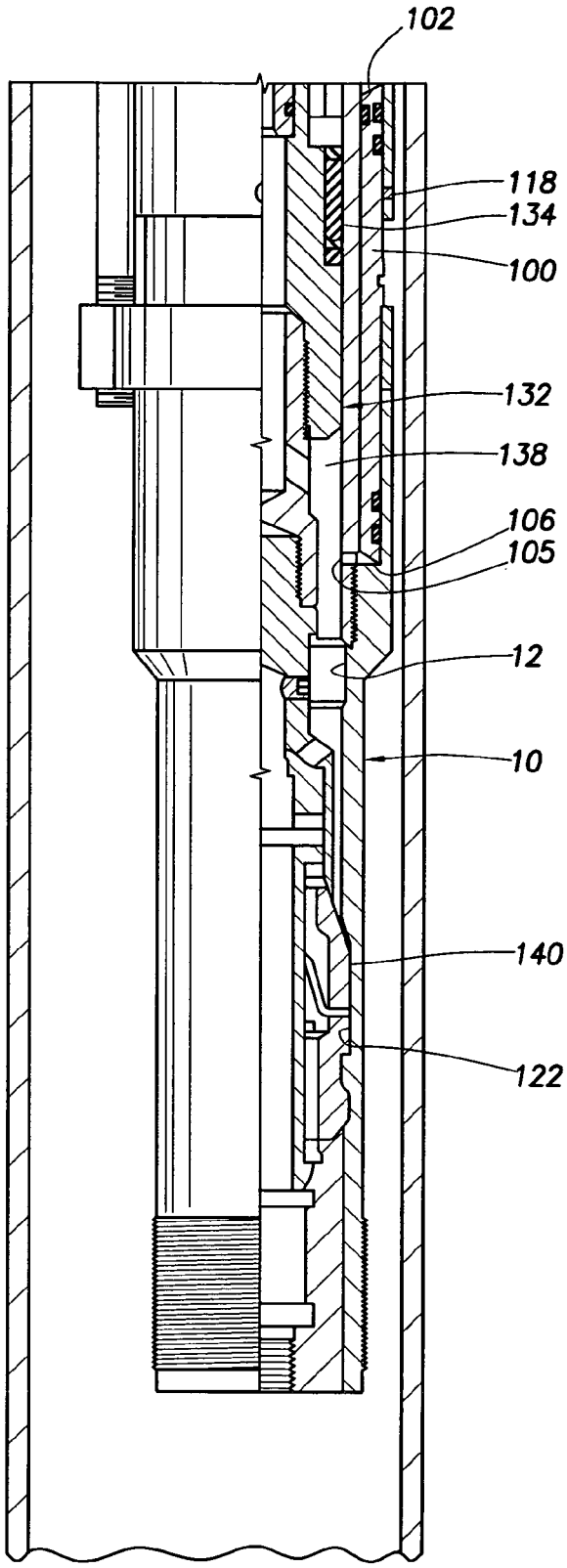

As depicted in FIGS. 5D and 5E, a plug 132 conveyed through the primary flow passage 12 is sealingly engaged in the primary flow passage. For example, the plug 132 may be conveyed through the flow passage 12 by wireline, coiled tubing, pumping the plug down the primary string 126, etc. Seals 134 carried on the plug 132 seal against the flow passage 12 between the ports 104, 105, thereby isolating an upper portion 136 of the primary flow passage 12 in communication with the upper side 102 of the piston 100 via the port 104 from a lower portion 138 of the flow passage 12 in communication with the lower side 106 of the piston via the port 105.

To ensure accurate positioning of the seals 134 between the ports 104, 105, a latch or other anchoring device 140 of the plug 132 engages the internal no-go profile 122 formed in the flow passage 12. Other anchoring and positioning means may be used for positioning the seals 134 so that they isolate the upper flow passage portion 136 from the lower flow passage portion 138, without departing from the principles of the invention.

Pressure in the upper flow passage portion 136 is communicated to the upper side 102 of the piston 100, while pressure in the lower flow passage portion 138 is communicated to the lower side 106 of the piston, and each is isolated from the other, when the plug 132 has been installed. The pressure differential may be applied across the piston 100 to bias it downwardly by increasing pressure in the upper passage portion 136, for example, by applying pressure to the primary tubing string 126 at a remote location, such as by using a pump at the earth's surface. Of course, the piston 100 could alternatively be biased downwardly by applying the pressure differential in another manner, such as by decreasing pressure in the lower passage portion 138.

As depicted in FIGS. 5A–E. pressure has been applied to the upper flow passage portion 136 after installing the plug 132, thereby applying the pressure differential across the piston 100. The downwardly biasing force due to the pressure differential acting on the piston 100 has caused the shear screws 118 to shear, permitting the downwardly biasing force to be transmitted to the release clamp 98 via the coupling 108. The downwardly biasing force has also caused the shear pins 120 to shear, permitting the release clamp 98 to displace downwardly, thereby releasing the packer 10, as explained in detail below with reference to FIGS. 6A–6E. In FIG. 5D, the release clamp 98 has released the anchor ring 84, thereby decoupling the release sleeve 80 from the mandrel 11, but the release sleeve 80 has not yet moved downward relative to the mandrel 11.

FIGS. 6A through 6E illustrate the configuration of packer 10 after it has been released by any release apparatus or method which moves the release clamp 98 downward. Release clamp 98 has been moved downward so that it released the release anchor 84, decoupling the release sleeve 80 from mandrel 11. The release sleeve 80 has moved downward under its own weight and as a result of the setting forces in the seal element 18. The release sleeve 80 is connected to the lower wedge 74 and carries it downward allowing the lower slip 22 to contract radially and disengage from the well casing. The slip 22 is coupled through the adaptor 72, the inner piston sleeve 60 and the outer piston sleeve 58 to the lower element retainer 57. All of these coupled parts move downward with the release sleeve 80, until the element retainer 57 makes contact with a pickup ring 59 carried on mandrel 11. The movement of the lower element retainer 57 releases the setting forces which were applied to the sealing elements 18.

At this point, the seal elements 18 may still be located at least partially on the prop surface 56 and may still be in sealing engagement with the well casing 124. To completely release the seal elements 18 and the upper slip 16, upward force is applied to the mandrel 11. Note that removal of the packer 10 from a well occurs by lifting, i.e. applying upward force to, the mandrel 11 and this motion simultaneously completes the release or unsetting process. The mandrel 11 may move upward relative to the set of components including the wedge 32, slip 16, wedge 40 and the seal elements 18, since the setting forces below elements 18 have been removed. The amount of movement is limited by various elements including a pick up pin 142 connected to upper wedge 32 and sliding in a slot 144 in upper sub 33. The movement is sufficient to allow the seal elements 18 to move off of the prop surface 56 to a smaller diameter portion 54 of the mandrel 11. This movement therefore releases the seal elements 18 from the well casing 124 and allows the wedge 40 to move downward relative to slip 16 and allows the slip 16 to move downward relative to the wedge 32. These movements occur as the mandrel 11 is moved upward and disengages the slip 16 from the well casing 124. The entire packer 10 can then be pulled from the well by continued upward movement of the mandrel 11.

Figure 6A:
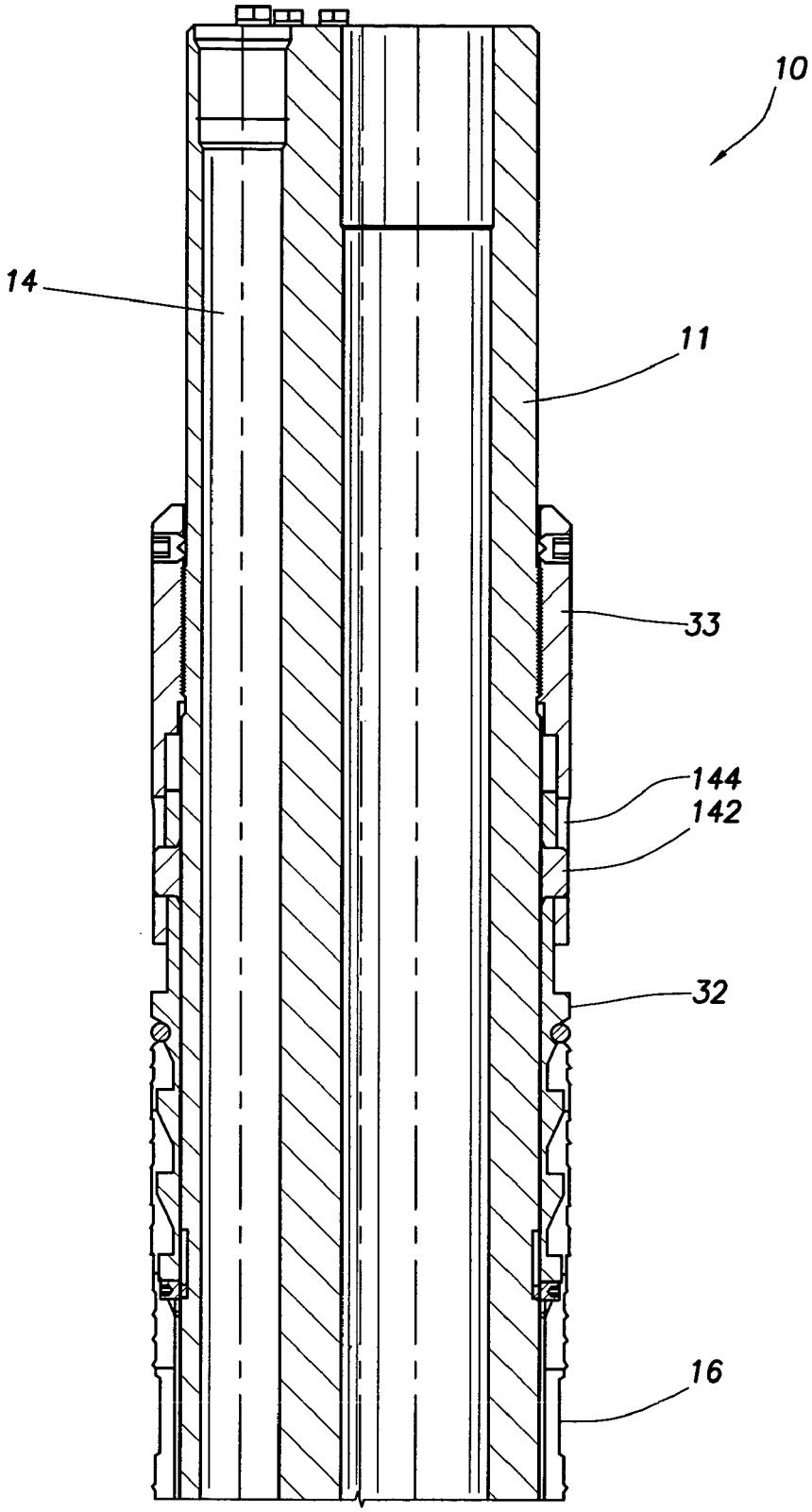
FIGS. 6A–E are successive axial portions of a cross-sectional view of the packer in its released configuration.
Figure 6B:
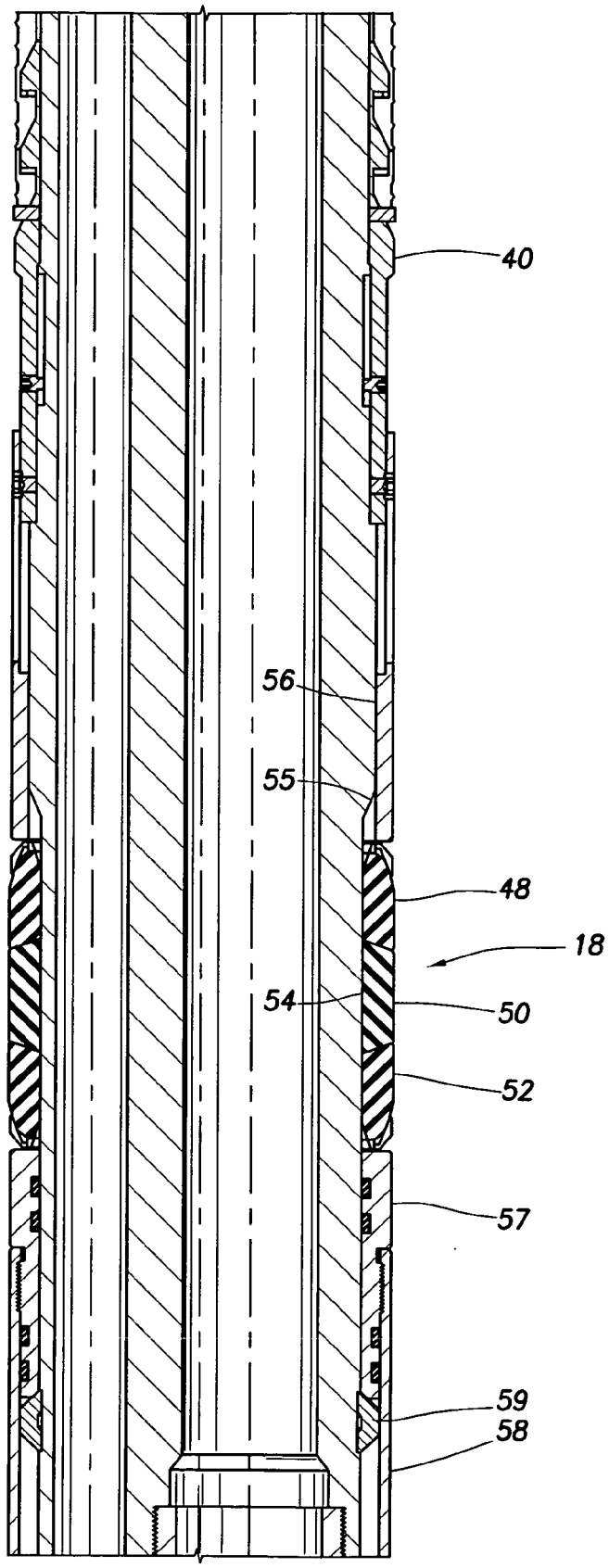
Figure 6C:
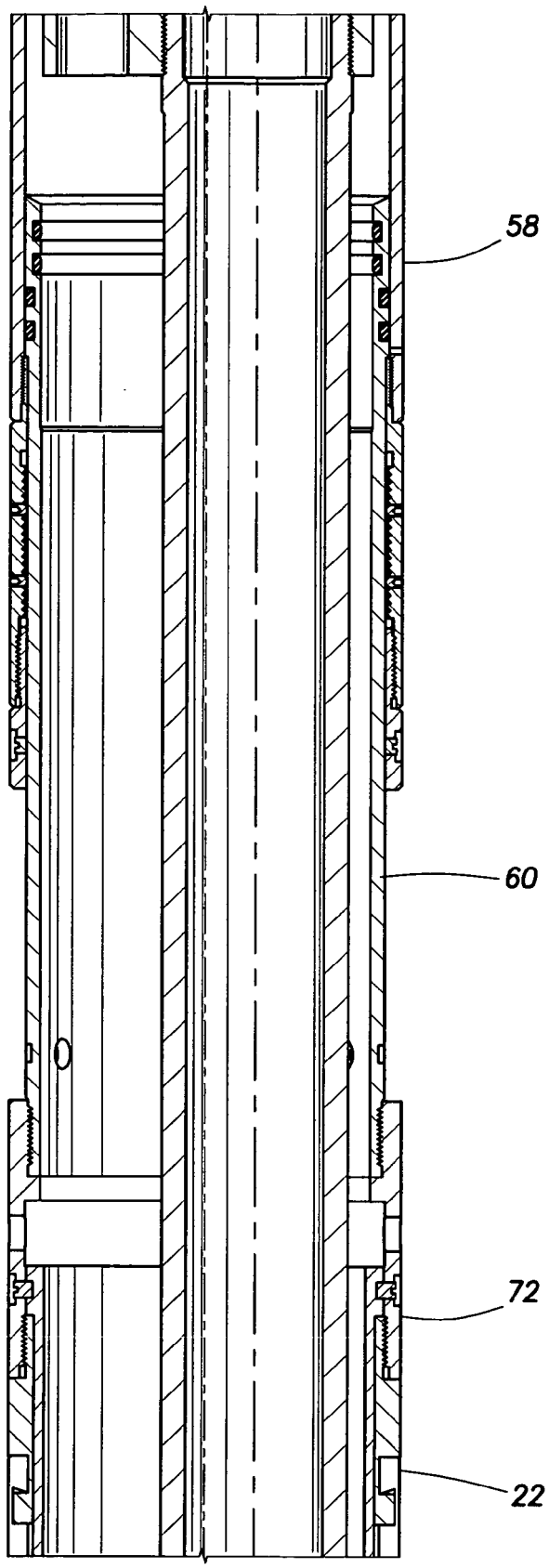
Figure 6D:
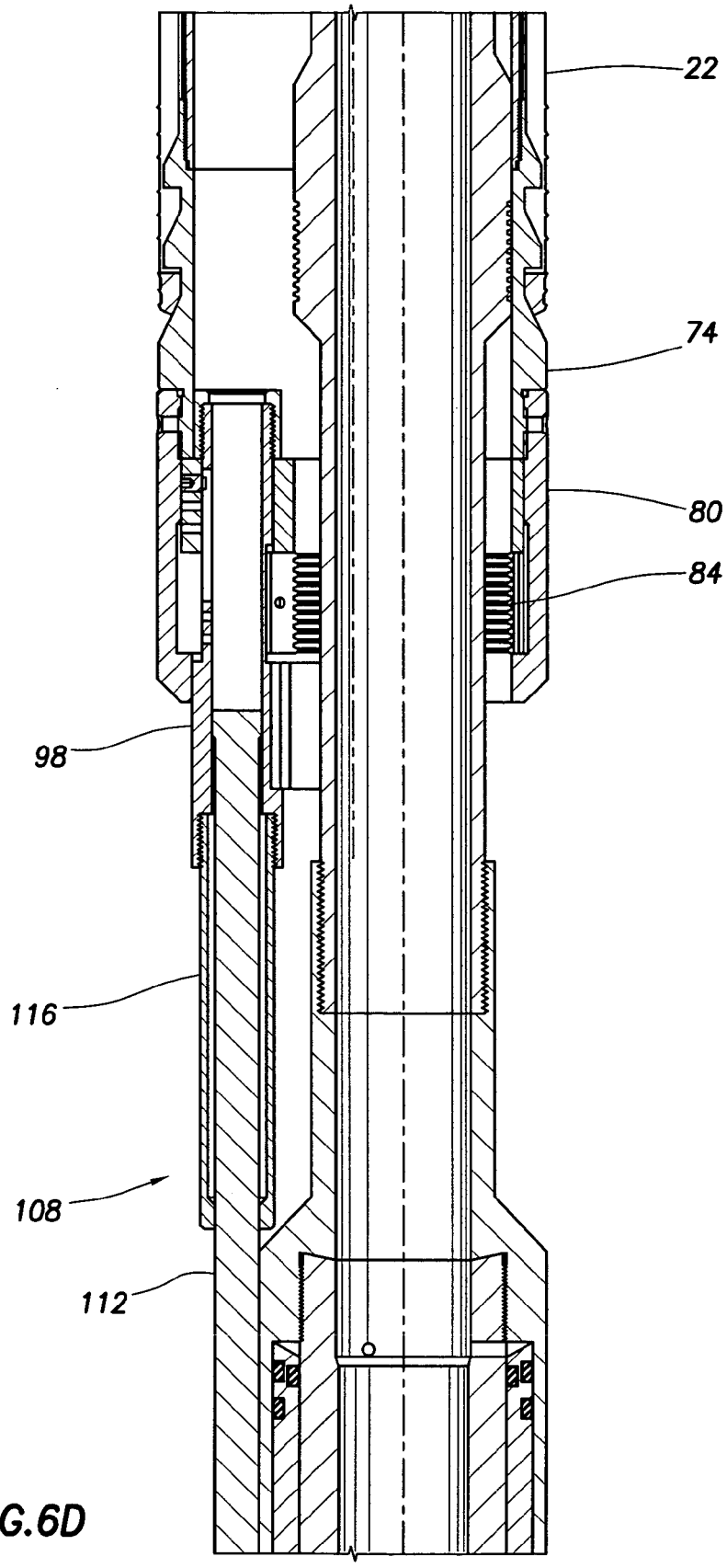
Figure 6E:
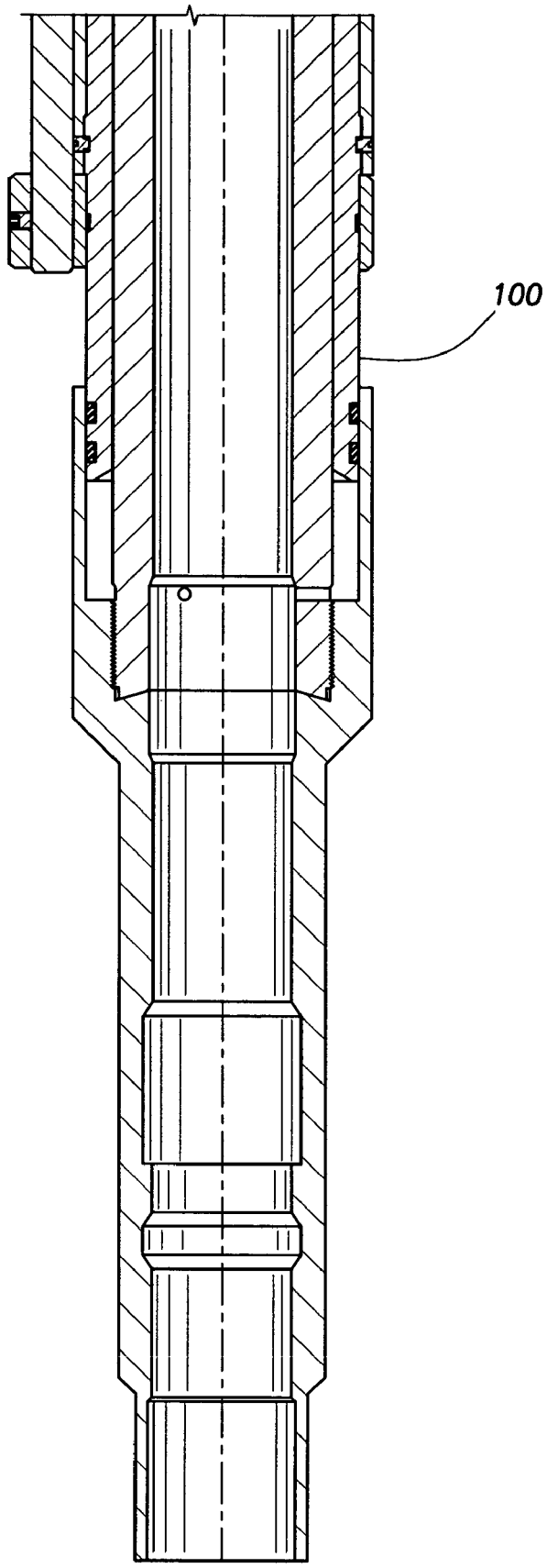

In FIGS. 6A–6E, the packer 10 has been released by moving the release clamp downward to release the release anchor 84. However, as shown in FIGS. 6D and 6E, this has been done without moving the cylinder 100, as was shown in FIGS. 5D and 5E. Instead, an apparatus has been conveyed down the secondary flow path 14 to apply a force to the top of the release clamp 98 and force it to its lower position. Various apparatus and methods are described below for doing this. FIG. 6D illustrates how the connecting rod 112 telescopes inside the sleeve 116 and inside part of the release clamp 98 when the packer release has been triggered this way and the release sleeve 80 has moved to its lowermost position.

Figure 7:
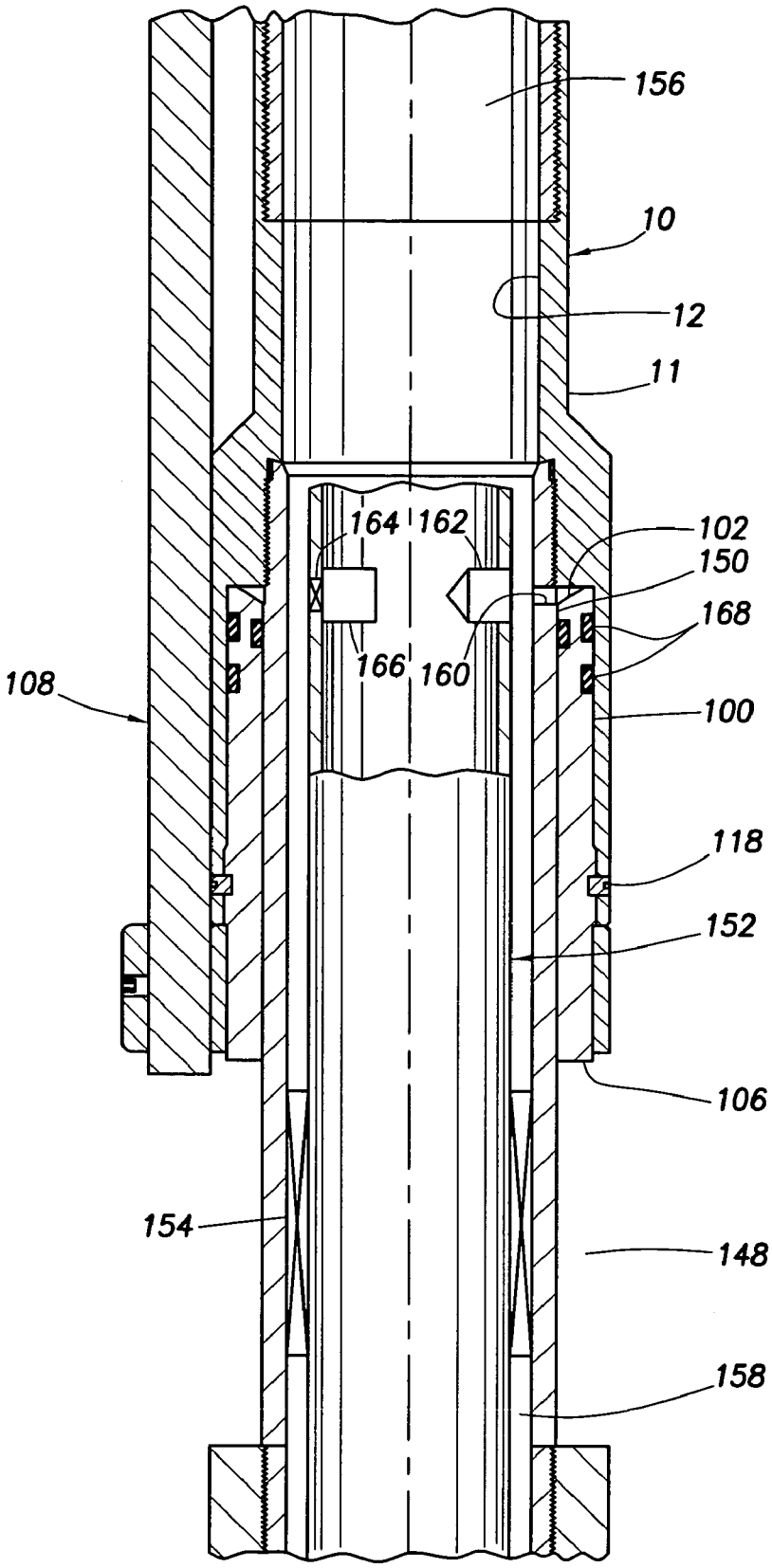
FIG. 7 is a cross-sectional view of an axial portion of another embodiment of the packer.

Referring additionally now to FIG. 7, another apparatus and method of releasing the packer 10 is representatively illustrated. The piston 100 has been modified so that its lower piston area or side 106 is in communication with the exterior of the packer 10. When the packer 10 is installed in a well bore, the exterior of the packer corresponds to an annulus 148 formed between the packer and the well bore 124.

In addition, in the method illustrated in FIG. 7, the port 104 shown in FIG. 1F does not initially exist as described above. Instead, the upper side 102 of the piston 100 is initially isolated from the primary flow passage 12 by a barrier 150. As illustrated in FIG. 7, the barrier 150 is a sidewall of the mandrel 11.

The upper side 102 of the piston 100 may be placed in fluid communication with the primary flow passage 12 by conveying a perforating device 152 through the flow passage and into the packer 10 as depicted in FIG. 7. The perforating device 152 includes a plug 154 for sealing engagement in the primary flow passage 12 and isolating an upper portion 156 of the flow passage from a lower portion 158 of the flow passage.

The perforating device 152 may be accurately positioned relative to the packer 10 by using an anchoring device, such as the anchoring device 140 described above, attached to the perforating device.

An opening 160 is formed through the sidewall 150 of the mandrel 11 by firing a shaped charge 162 of the perforating device 152. Alternatively, the opening 160 may be formed by chemically cutting through the barrier, for example, by opening a valve 164 to release a chemical from a container 166 of the perforating device 152. Other methods of forming the opening 160 may be used in keeping with the principles of the invention.

It will now be appreciated that, with the opening 160 formed, a downwardly biasing force may be applied to the piston 100 by increasing the pressure in the upper portion 156 of the primary flow passage 12 relative to pressure in the annulus 148. For example, pressure may be applied to the primary tubing string 126 at a remote location, such as by using a pump at the earth's surface. When a sufficiently great downwardly biasing force is applied to the piston 100 by the pressure differential, the shear screws 118 shear, the downwardly biasing force is transmitted by the coupling 108 to the release clamp 98, and the packer 10 is released.

Note that the modified piston 100 of FIG. 7 could be substituted for the piston illustrated in FIG. 1F. That is, the packer 10 embodiment of FIGS. 1A–1G could be configured as illustrated in FIG. 7, so that the piston 100 displaces in response to a pressure differential between the primary flow passage 12 and the annulus 148. The port 104 could be initially provided (and the port 105 eliminated), so that the upper side 102 of the piston 100 is initially in fluid communication with the upper portion 156 of the primary flow passage 12. Alternatively, an opening, such as the opening 160 illustrated in FIG. 7, could be formed after the packer 10 is set in the well bore 124.

As another alternative, the perforating device 152 could be used in the packer 10 illustrated in FIGS. 1A–G, that is, in the packer configured so that the piston 100 displaces in response to a pressure differential applied between isolated portions 136, 138 of the primary flow passage 12. In this alternative, the perforating device 152 could be used to form one or both of the ports 104, 105 when it is desired to apply the pressure differential to the piston 100 to release the packer 10.

An advantage of forming the ports 104, 105 or opening 160 only when it is desired to release the packer, is that this prevents exposure of the piston 100 and its seals 168 to fluid in the primary flow passage 12. The packer may be set in a well for a number of years during which fluids are produced through flow passage 12. During this time, the barrier 150 isolates the piston 100 and its seals 168 from those produced fluids and provides increased reliability by isolating the flow passage from the annulus 148.

Figure 8:
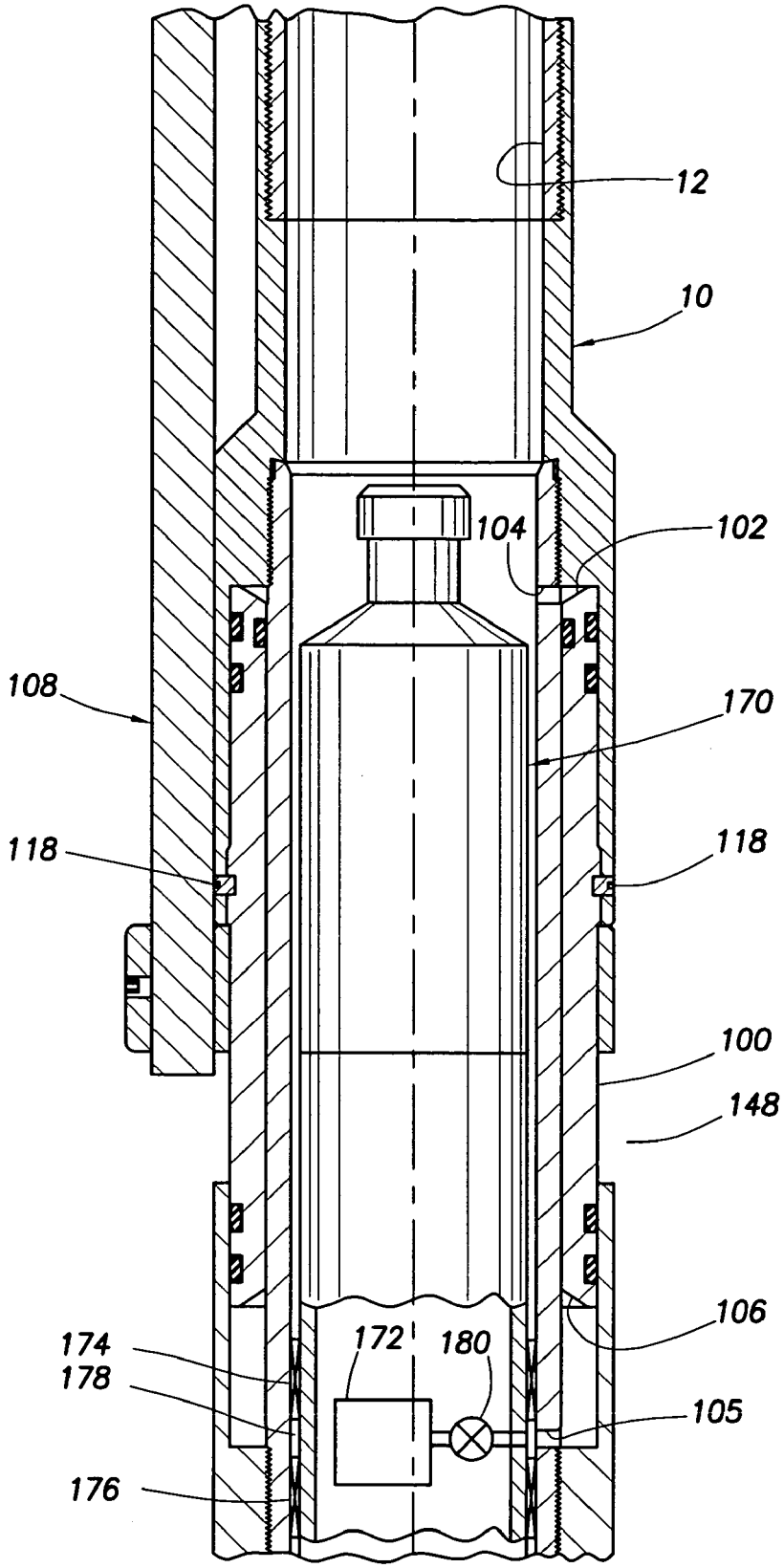
FIG. 8 is a cross-sectional view of an axial portion of another embodiment of the packer.

Referring additionally now to FIG. 8, another apparatus and method of releasing the packer 10 is representatively illustrated. A releasing device 170 including a pressure chamber 172 is conveyed into the primary flow passage 12. The device 170 may be anchored in position relative to the packer 10 as depicted in FIG. 8 by using an anchoring device, such as the anchoring device 140 described above, attached to the device 170.

The device 170 includes seals 174, 176 which sealingly engage the flow passage 12 straddling the lower port 105. The seals 174,176 isolate an annular portion 178 of the flow passage 12 from the remainder of the flow passage. The annular passage portion 178 is in fluid communication with the lower port 105. When a valve 180 is opened, the lower side 106 of the piston 100 is placed in fluid communication with the pressure chamber 172.

The pressure chamber 172 may contain, for example, air at atmospheric pressure. In this example, opening the valve 180 will cause a reduction in the pressure applied to the lower side 106 of the piston 100, increasing the differential between the pressure in the remainder of the flow passage 12 applied via the upper port 104 to the upper side 102 of the piston and the pressure in the annular portion 178 of the flow passage. This increased pressure differential applies a downwardly biasing force to the piston 100.

When the downwardly biasing force is sufficiently great, the shear screws 118 will shear, thereby transmitting the force to the release clamp 98 via the coupling 108. The shear pins 120 will also shear when the sufficiently great downwardly biasing force is applied to the release clamp 98, the retaining device will displace downwardly, and the packer 10 will be released as described above.

In the above description of FIG. 8, the chamber 172 contains pressure less than that in the flow passage 12 in order to create a pressure differential across the piston 100. Alternatively, the chamber 172 could contain pressure greater than that in the flow passage 12, and could be applied to the piston 100 via the upper port 104 while the lower port 105 remains in fluid communication with the flow passage, to thereby apply the pressure differential across the piston. In that case, the seals 174, 176 would be positioned straddling the upper port 104.

Although the piston 100 is depicted in FIG. 8 as being responsive to a pressure differential applied from the flow passage 12, it will be appreciated that the piston could be responsive to a pressure differential applied between the flow passage and the annulus 148 (as depicted in FIG. 7), or the piston could be responsive to otherwise applied pressure differentials, without departing from the principles of the invention.

Although in the FIG. 8 embodiment, the ports 104, 105 are already formed when the device 170 is conveyed into the packer 10, it will be appreciated that a device, such as the perforating device 152 described above, could be used to form one or both of the ports prior to applying the pressure differential in the method. Other means of providing fluid communication with the piston 100 may be used in keeping with the principles of the invention.

Figure 9A:
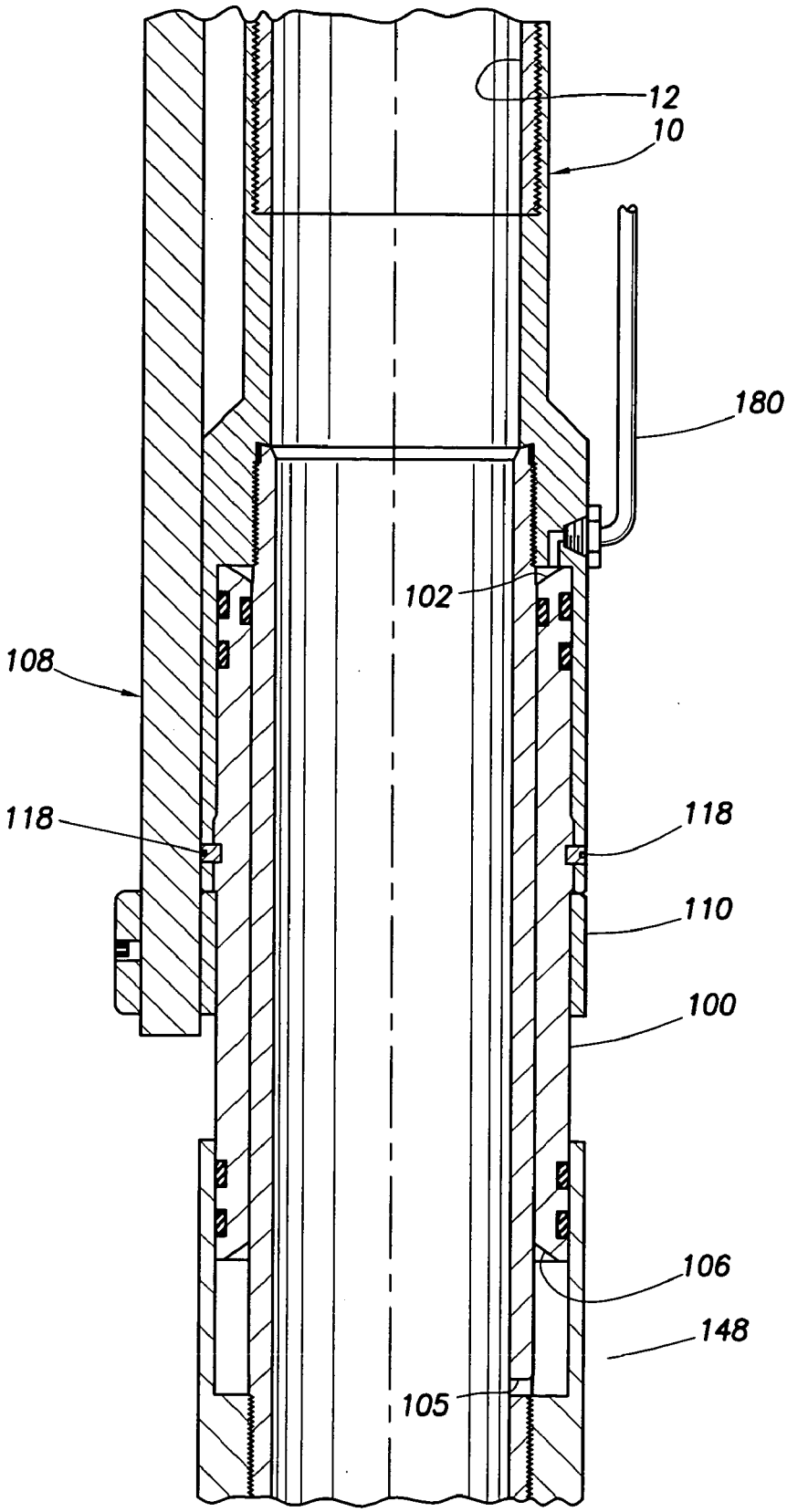
FIGS. 9A&B are cross-sectional views of axial portions of another embodiment of the packer.

Referring additionally now to FIGS. 9A&B, another apparatus and method for releasing the packer 10 is representatively illustrated. In this embodiment, the piston 100 is responsive to a pressure differential between a control line 180 and the flow passage 12. Pressure is applied to the upper side 102 of the piston 100 through the control line 180, and pressure is applied to the lower side 106 of the piston via the lower port 105. Note that the upper port 104 is eliminated in this embodiment of the packer 10.

The control line 180 is depicted in FIG. 9A as being separately and externally connected to the packer 10. For example, the control line 180 could extend to a remote location, such as the earth's surface. However, the control line 180 could be internally formed in the packer 10, e.g. one of the pathways 13 shown in FIG. 3, and could be integrally formed with another structure of the packer. For example, in FIG. 9B, an upper portion of the control line 180 is depicted as being internally formed, and integrally formed in the mandrel 11.

To release the packer 10, pressure is applied to the control line 180 to create a pressure differential between the control line and the flow passage 12. Pressure may be applied to the control line 180 at a remote location, such as by using a pump at the earth's surface. This pressure differential results in a downwardly biasing force being applied to the piston 100.

When the downwardly biasing force is sufficiently great, the shear screws 118 will shear, thereby transmitting the force to the release clamp 98 via the coupling 108. The shear pins 122 will also shear when the sufficiently great downwardly biasing force is applied to the release clamp 98, the retaining device will displace downwardly, and the packer 10 will be released as described above.

Figure 9B:
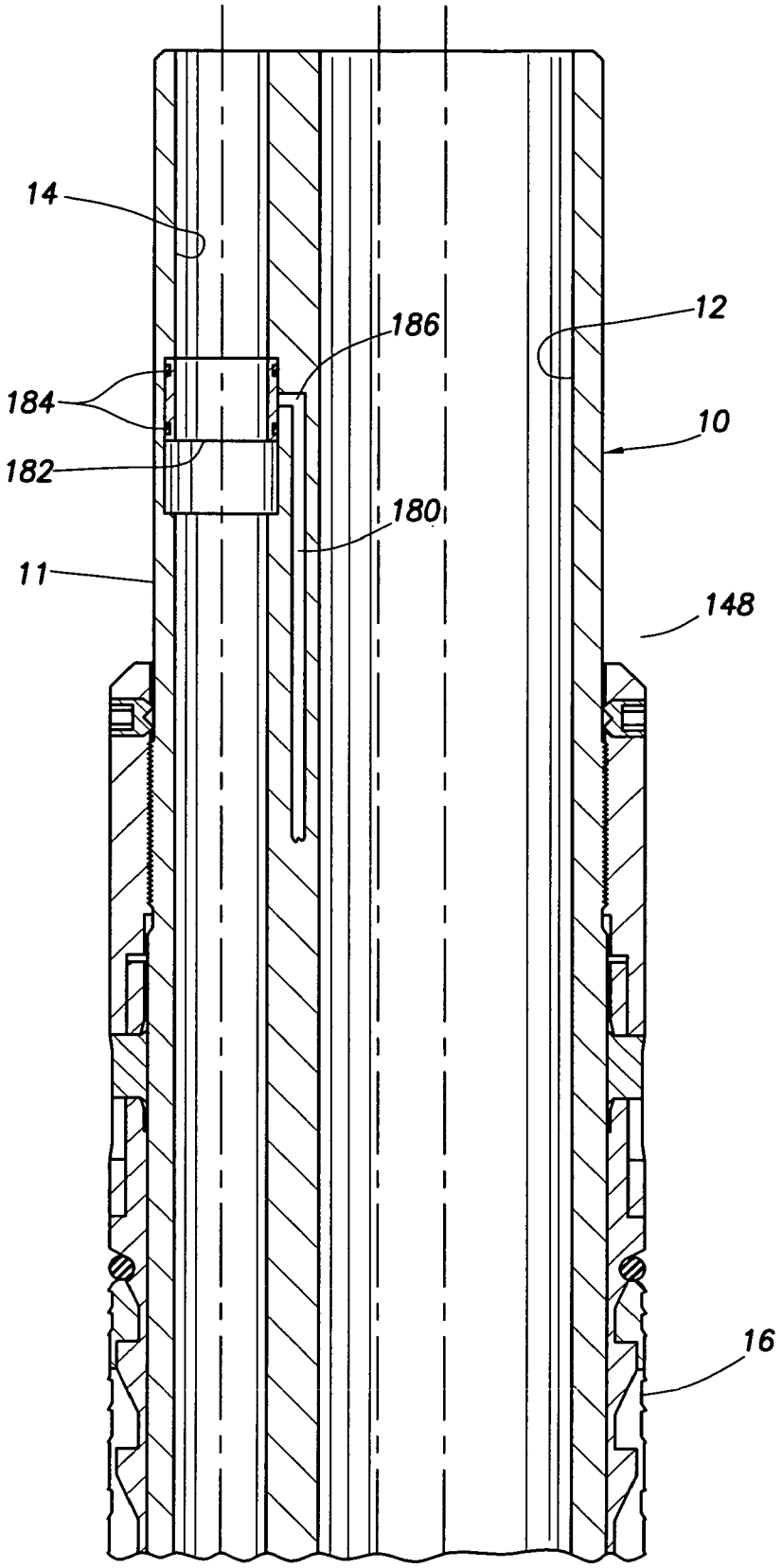

Instead of extending the control line 180 to a remote location, such as the earth's surface, in order to apply pressure to the control line, an alternative is depicted in FIG. 9B. In this alternative embodiment, the control line 180 extends to the secondary flow passage 14, extending internally in the mandrel 11. Fluid communication between the control line 180 and the flow passage 14 is initially prevented by a sleeve 182 or other member in the flow passage.

The sleeve 182 has seals 184 which initially straddle a port 186 extending from the control line 180 to the flow passage 14. By displacing the sleeve 182 downward, the port 186 may be exposed to the flow passage 14, thereby providing fluid communication between the flow passage and the control line 180. The sleeve 182 may be displaced downward using a variety of methods, such as by using a wireline or coiled tubing conveyed shifting tool, providing a differential piston area on the sleeve and applying pressure to the flow passage 14 to apply a biasing force to the sleeve, etc.

Furthermore, other means of providing selective fluid communication between the flow passage 14 and the control line 180, for example, a kobe or break plug, or a perforating device such as the perforating device 152, may be used without departing from the principles of the invention.

After the control line 180 is placed in fluid communication with the flow passage 14, pressure applied to the secondary tubing string 128 at a remote location, such as the earth's surface, is applied to the top side 102 of the piston 100. By applying a sufficiently great pressure differential between the control line 180 and the flow passage 12, the piston 100 may be displaced downwardly to release the packer 10 as described above.

Although the piston 100 is depicted in FIG. 9A as being responsive to a pressure differential applied between the control line 180 and the flow passage 12, it will be appreciated that the piston could be responsive to a pressure differential applied between the control line and the annulus 148 (as depicted in FIG. 7), or the piston could be responsive to otherwise applied pressure differentials, without departing from the principles of the invention.

Although in the embodiment of FIG. 9A, the port 105 is already formed when the packer 10 is installed in the well bore, it will be appreciated that a device, such as the perforating device 152 described above, could be used to form the port prior to applying the pressure differential in the method. Other means of providing fluid communication with the piston 100 may be used in keeping with the principles of the invention.

Figure 10:
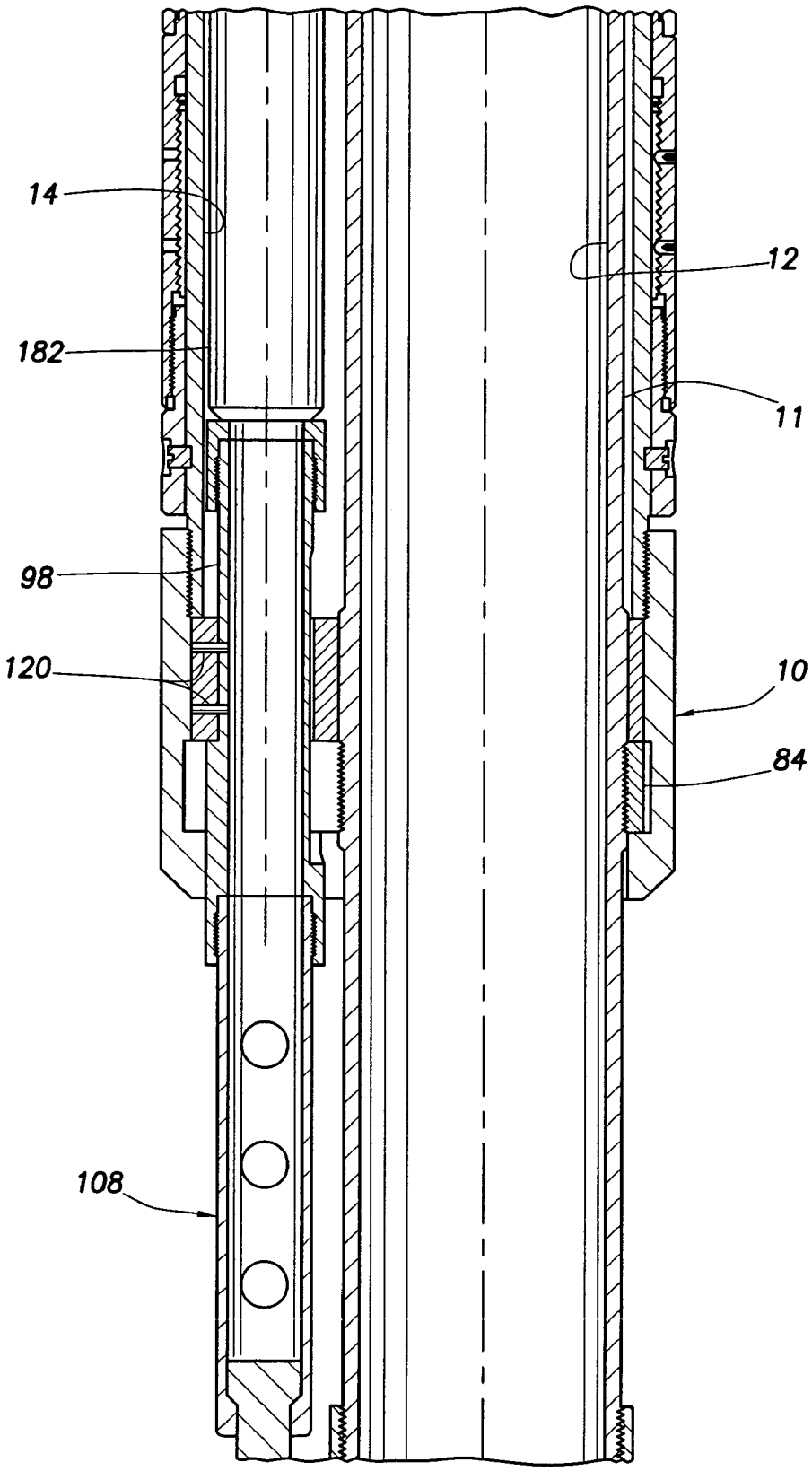
FIG. 10 is a cross-sectional view of an axial portion of another embodiment of the packer.

Referring additionally now to FIG. 10 another apparatus and method for releasing the packer 10 is representatively illustrated. In the embodiment of FIG. 10, a displacement structure 182 is conveyed through the flow passage 14 to apply a downwardly directed force to the release clamp 98. The structure 182 may be any structure suitable for this purpose. For example, the structure 182 may be a drop bar which is dropped through the secondary tubing string 128 to impact the release clamp 98. The structure 182 could be the lower end, such as a blind box, of a wireline conveyed jarring assembly.

When a sufficiently great downwardly directed force is applied by the structure 182 to the release clamp 98, the shear pins 120 will shear. The release clamp 98 will then displace downwardly, permitting the release anchor 84 to expand, and thereby releasing the packer 10 as described above. The coupling 108 permits the release clamp 98 to displace downwardly, without the piston 100 also displacing.

Note that the FIG. 10 embodiment for releasing the packer 10 does not require application of pressure to the packer, and does not require entry into the primary flow passage 12.

Figure 11:
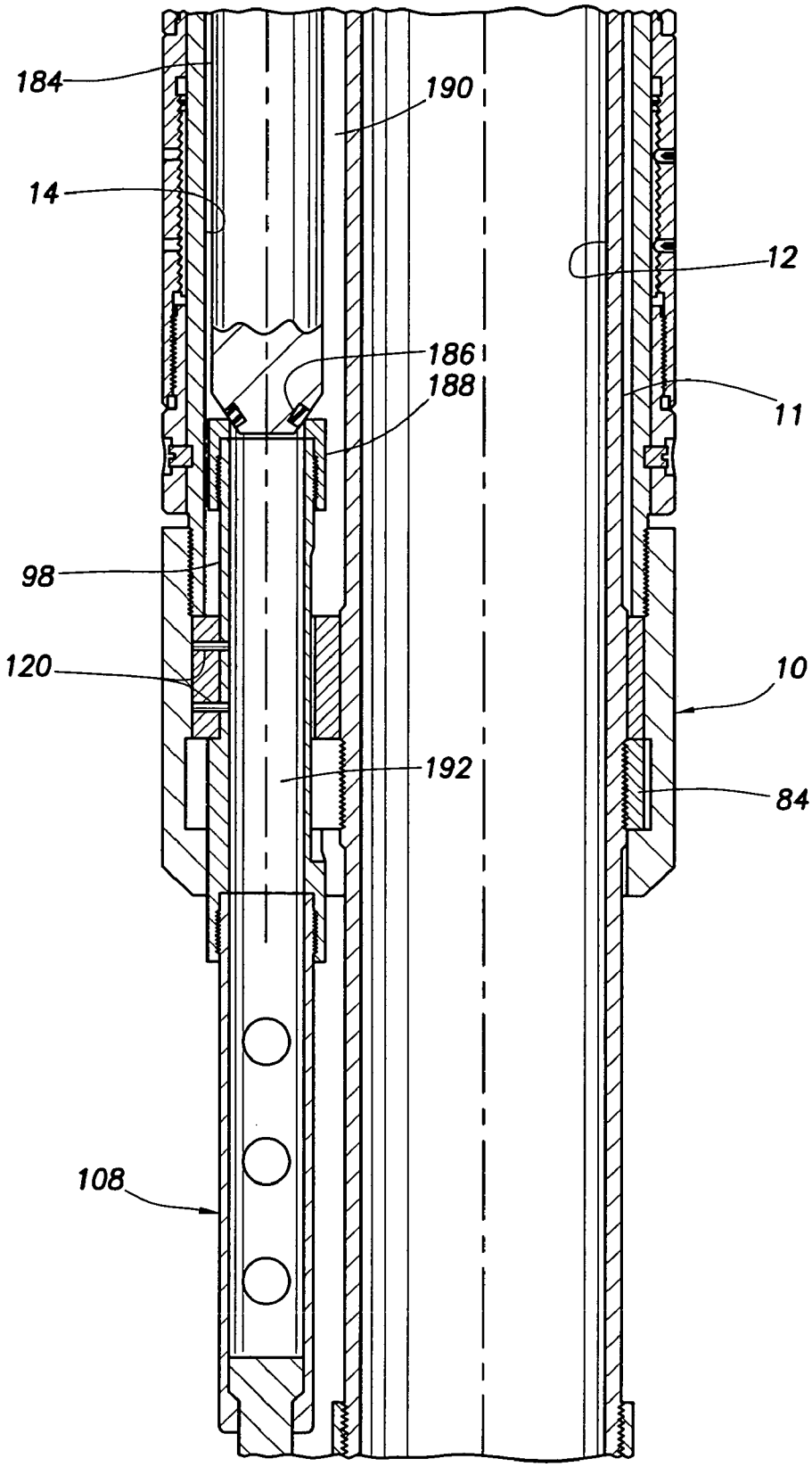
FIG. 11 is a cross-sectional view of an axial portion of another embodiment of the packer.

Referring additionally now to FIG. 11, another apparatus and method for releasing the packer 10 is representatively illustrated. In embodiment of FIG. 11, a displacement structure 184 conveyed through the flow passage 14 for engagement with the release clamp 98 actually seals against the release clamp 98, so that a pressure differential may be created thereacross.

A seal 186 carried on the displacement structure 184 sealingly engages an upper tubular cap 188 of the release clamp 98. The seal 186 may be an elastomer, metal to metal, or any other type of seal, and it may be integrally formed on the displacement structure 184.

When the seal 186 engages the cap 188, an upper portion 190 of the flow passage 14 is effectively isolated from a lower portion 192 of the flow passage. In this embodiment, the release clamp 98 is sealed in the flow passage 14, for example, using a seal carried on the release clamp 98. A pressure differential may be created from the upper portion 190 to the lower portion 192 by applying pressure to the secondary tubing string 128 at a remote location, such as the earth's surface. This pressure differential acting across the release clamp 98 will bias the retaining device in a downward direction.

When a sufficiently great downwardly directed force is applied by the displacement structure 184 to the release clamp 98, the shear pins 120 will shear. The release clamp 98 will then displace downwardly, permitting the release anchor 84 to expand, and thereby releasing the packer 10 as described above. The coupling 108 permits the release clamp 98 to displace downwardly, without the piston 100 also displacing.

Figure 12:
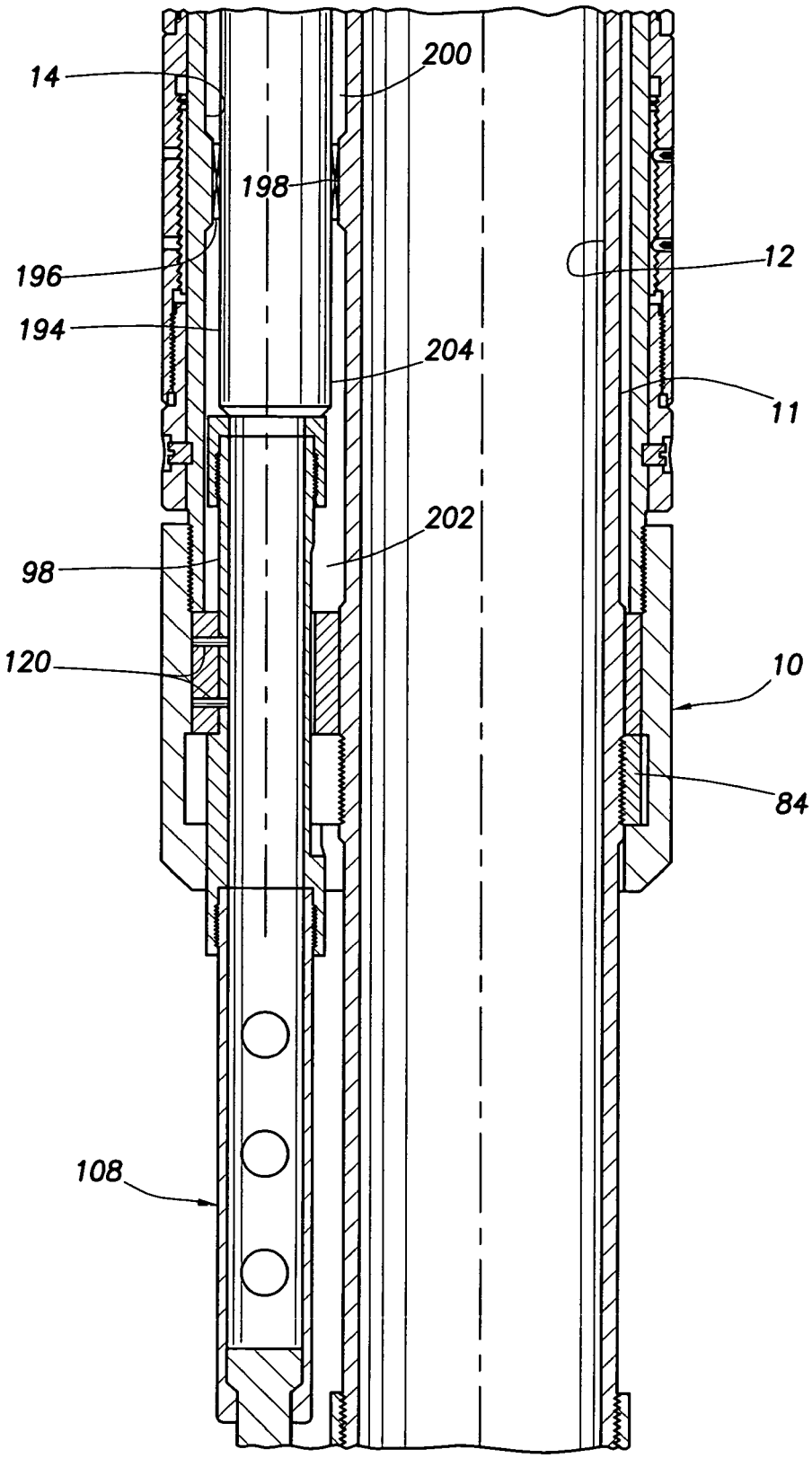
FIG. 12 is a cross-sectional view of an axial portion of another embodiment of the packer.

Referring additionally now to FIG. 12, another method and apparatus for releasing the packer 10 is representatively illustrated. In the FIG. 12 embodiment, a displacement structure 194 carrying a seal 196 thereon is conveyed through the flow passage 14. The seal 196 sealingly engages a radially reduced seal bore 198 formed in the flow passage 14, thereby isolating an upper portion 200 from a lower portion 202 of the flow passage.

A lower end 204 of the device 194 contacts the release clamp 98. When a pressure differential is created from the upper flow passage portion 200 to the lower flow passage portion 202, the lower end 204 of the device 194 applies a downwardly biasing force to the release clamp 98.

When a sufficiently great downwardly directed force is applied by the displacement device 194 to the release clamp 98, the shear pins 120 will shear. The release clamp 98 will then displace downwardly, permitting the release anchor 84 to expand, and thereby releasing the packer 10 as described above. The coupling 108 permits the release clamp 98 to displace downwardly, without the piston 100 also displacing.

As the release clamp 98 displaces downwardly, the displacement structure 194 also displaces downwardly therewith. As a result, the seal 196 eventually leaves the seal bore 198. When the seal 196 is no longer sealed within the seal bore 198, the pressure differential applied between the upper and lower portions 200, 202 of the flow passage 14 will be relieved. If the pressure differential was applied by increasing pressure in the secondary tubing string 128, then this increased pressure will be relieved, thus providing a signal to the remote location that the displacement structure 194 and the release clamp 98 have displaced downwardly in response to the differential pressure. For example, this signal may alert an operator at the earth's surface that no further pressure increase is to be applied, and that the packer 10 has been released.

Figure 13:
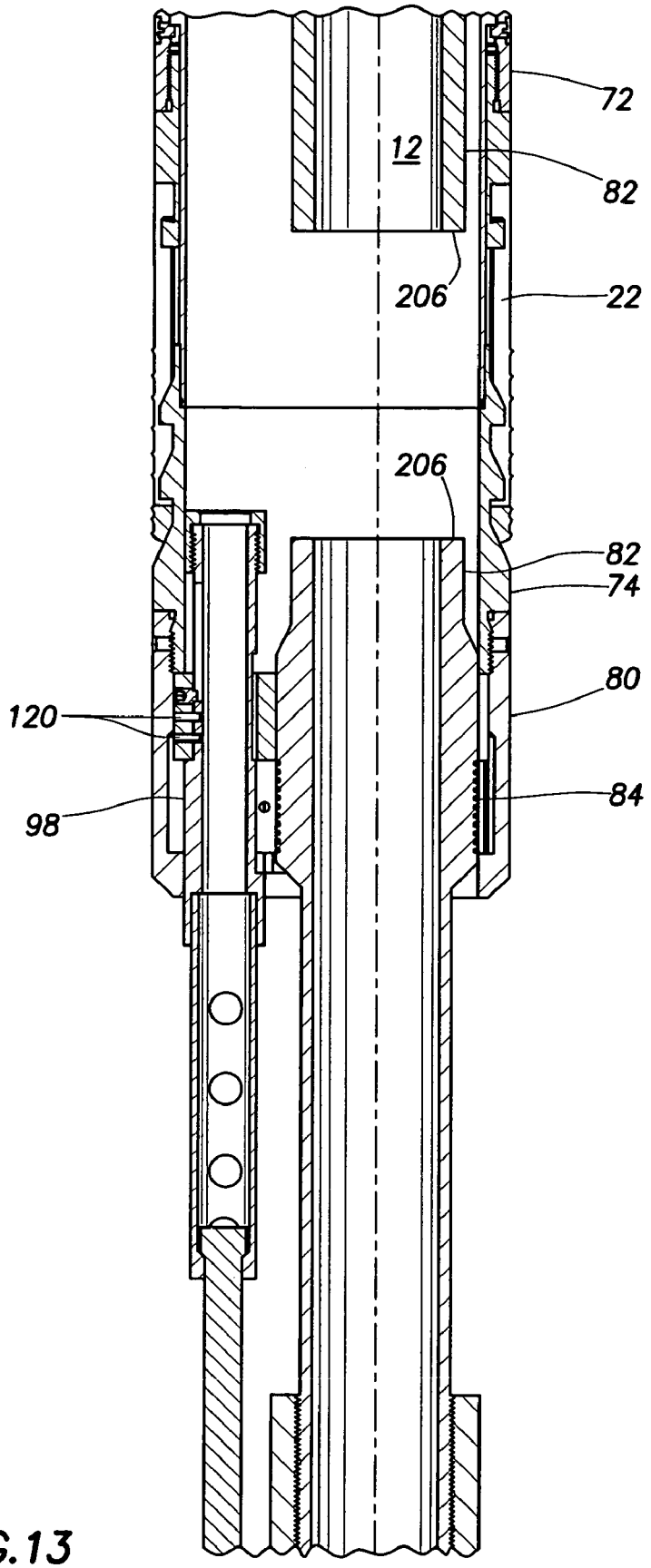
FIG. 13 is a cross-sectional view of an axial portion of another embodiment of the packer.

With reference to FIG. 13, another method of releasing the packer 10 is illustrated. In this embodiment, the release clamp 98 may remain in its run and set configuration held in that position by the shear pins 120. The piston 100 also may remain in its run and set position held in place by shear screws 118. The release ring 80 is moved downward relative to the mandrel 11 by shearing the mandrel extension 82. A conventional explosive tubing cutter may be run down the primary flow path 12 and fired in the extension 82 to sever the extension 82 at 206 as illustrated. Alternatively, a chemical cutter, mechanical cutter, or other known means of severing tubing downhole may be used to sever the extension 82. The tubing cutter, chemical cutter, etc. may be properly positioned by use of the profile 122 as shown in FIGS. 1G and 5E. When the extension 82 is cut, the release ring 80 drops downward together with the lower portion of the extension 82 to which it is still attached by the anchor ring 84. As the release ring 80 moves downward it moves the wedge 74 downward, releasing slip 22, and carries the other connected elements, e.g. adaptor 72, piston sleeves 58 and 60 and the lower element retainer 57, until the element retainer 57 is stopped by the pickup ring 59 as shown in FIG. 6B. Once the release ring 80 and connected elements have thus moved down and are supported on the pickup ring 59, the packer may be removed from the well by upward movement of the mandrel 11 as described above with reference to FIGS. 6A–6E.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. Apparatus operatively positionable within a subterranean well, comprising:

a mandrel;

a double acting slip and a single acting slip carried on the mandrel, the double acting slip being spaced axially apart from the single acting slip; and a seal element carried on the mandrel.

2. The apparatus according to claim 1, where the mandrel is disposed axially between the double acting slip and the single acting slip.

3. The apparatus according to claim 1, further comprising first and second wedges disposed at least partially radially between the double acting slip and the mandrel, and a third generally conical wedge disposed at least partially radially between the single acting slip and the mandrel.

4. The apparatus according to claim 3, wherein the double acting slip is radially outwardly extendable relative to the mandrel by displacing the second wedge in a first axial direction relative to the mandrel, and wherein the single acting slip is radially outwardly extendable relative to the mandrel by displacing the single acting slip in a second axial direction, opposite to the first axial direction, relative to the mandrel.

5. The apparatus according to claim 4, further comprising first and second pistons carried on the mandrel axially between the second wedge and the single acting slip, each of the first and second pistons displacing one of the second wedge and the single acting slip in a respective one of the first and second axial directions when fluid pressure is applied to the first and second pistons.

6. The apparatus according to claim 5, further comprising an axially extendable internal ratchet assembly configured to prevent reduction of the axial distance between the second wedge and the single acting slip.

7. The apparatus according to claim 5, further comprising a release sleeve releasably coupled to the mandrel, preventing movement of the third wedge in the second axial direction when the release sleeve is coupled to the mandrel and allowing movement of the third wedge in the second axial direction when the release sleeve is decoupled from the mandrel.

8. The apparatus according to claim 7, further comprising means for decoupling the release ring from the mandrel.

9. The apparatus according to claim 7, further comprising:

a split ring carried between the mandrel and the release sleeve, the split ring engaging both the mandrel and the release sleeve when its split is closed and not engaging the mandrel when its split is open.

10. The apparatus according to claim 9, further comprising:

flanges carried on the split ring on each side of its split, and a clamp having a first position in which it holds the flanges together and having a second position in which it allows the flanges to separate.

11. The apparatus according to claim 10, further comprising means for moving the clamp from its first position to its second position.

12. The apparatus according to claim 1, wherein the double acting slip is a one piece barrel slip.

13. A packer settable within a tubular structure, the packer comprising:

a mandrel;

first and second axially spaced apart slips carried on the mandrel, the first and second slips being radially outwardly extendable into gripping engagement with the tubular structure when the packer is set therein, the first slip resisting a load applied to the mandrel in a first axial direction, and the second slip resisting another load applied to the mandrel in a second direction, opposite to the first direction;

a seal element carried on the mandrel, the seal element being radially outwardly extendable into sealing engagement with the tubular structure when the packer is set therein, a pressure differential in the first axial direction applied to the seal element being resisted by the second slip.

14. The apparatus of claim 13, wherein the seal element is carried between the first and second slips.

15. The apparatus of claim 13, further comprising first and second wedge members, the first wedge member being disposed at least partially between the first slip and the mandrel, and the second wedge member being disposed at least partially between the seal element and the second slip.

16. The packer according to claim 13, wherein the first slip is a single acting slip and the second slip is a double acting slip.

17. The packer according to claim 15, further comprising a third wedge member, the second slip being disposed at least partially between the second and third wedge members.

18. A method of securing an apparatus within a tubular structure disposed in a subterranean well, the method comprising the steps of:

disposing a double acting slip and a single acting slip axially spaced apart on the apparatus;

positioning the apparatus within the tubular structure;

radially outwardly extending the double acting slip and the single acting slip, each of the double acting slip and single acting slip grippingly engaging the tubular structure; and radially outwardly extending a circumferential seal element into sealing engagement with the tubular structure.

19. The method of claim 18, wherein the seal element is disposed axially between the double acting slip and the single acting slip.

20. The method of claim 18, further comprising disposing first and second wedges at least partially radially between the double acting slip and a generally tubular mandrel.

21. The method of claim 20, further comprising disposing a third wedge at least partially radially between the single acting slip and the mandrel.

22. The method according to claim 21, wherein radially outwardly extending the double acting slip is performed by displacing the second wedge in a first axial direction relative to the mandrel and displacing the single acting slip in a second axial direction, opposite to the first axial direction, relative to the mandrel.

23. The method according to claim 22, further comprising disposing first and second annular pistons on the mandrel, and applying fluid pressure to the pistons, thereby causing each of the first and second pistons to displace one of the second wedge and the single acting slip.

24. The method according to claim 23, further comprising releasably coupling the third wedge to the mandrel.

25. The method according to claim 24, further comprising decoupling the third wedge from the mandrel, and thereby releasing the apparatus from the tubular structure.

* * * * *